US012188237B2

(12) United States Patent
Wiggin

(10) Patent No.: US 12,188,237 B2
(45) Date of Patent: Jan. 7, 2025

(54) DECK RAIL SHELF

(71) Applicant: Peter E. Wiggin, Stratham, NH (US)

(72) Inventor: Peter E. Wiggin, Stratham, NH (US)

( * ) Notice: Subject to any disclaimer, the term of this patent is extended or adjusted under 35 U.S.C. 154(b) by 0 days.

(21) Appl. No.: 18/232,977

(22) Filed: Aug. 11, 2023

(65) Prior Publication Data

US 2023/0407640 A1 Dec. 21, 2023

Related U.S. Application Data

(63) Continuation-in-part of application No. 17/478,371, filed on Sep. 17, 2021, now Pat. No. 11,744,366.

(51) Int. Cl.

| | |
|---|---|
| ***A47B 57/30*** | (2006.01) |
| ***A47B 5/04*** | (2006.01) |
| ***A47B 96/02*** | (2006.01) |
| ***A47F 5/08*** | (2006.01) |
| ***A47F 5/10*** | (2006.01) |
| ***E04F 11/18*** | (2006.01) |

(52) U.S. Cl.

CPC ..... *E04F 11/1808* (2013.01); *A47B 5/04* (2013.01); *A47B 57/30* (2013.01); *A47B 96/028* (2013.01); *A47F 5/08* (2013.01); *A47F 5/103* (2013.01); *E04F 2011/1876* (2013.01)

(58) Field of Classification Search

CPC ..... E04F 11/1808; E04F 2011/1876; E04F 2011/1868; E04F 11/181; A47B 96/028; A47B 57/30; A47B 96/025; A47B 5/02; A47B 97/001; A47B 96/024; A47B 96/027; A47B 95/008; A47B 96/061; A47B 96/067; A47B 96/14; A47B 5/04; A47F 5/103; A47F 5/10; A47F 5/08

USPC ..... 211/187, 193, 90.01, 90.02, 103, 104; 248/250, 240.4, 235, 240, 240.1, 240.3; 108/134, 135, 47, 48, 152, 157.13

See application file for complete search history.

(56) References Cited

U.S. PATENT DOCUMENTS

| | | | | | |
|---|---|---|---|---|---|
| 582,799 | A | * | 5/1897 | Randow | A47C 9/002 248/240.4 |
| 1,068,391 | A | * | 7/1913 | Jensen | F21V 21/08 211/35 |
| 1,085,670 | A | * | 2/1914 | Cronk | B60R 9/06 248/240.4 |
| 1,232,874 | A | * | 7/1917 | Whealer | A47B 27/02 108/4 |
| 1,258,158 | A | * | 3/1918 | Sims | F03G 1/00 185/40 H |

(Continued)

*Primary Examiner* — Jennifer E. Novosad

(74) *Attorney, Agent, or Firm* — LORUSSO & ASSOCIATES

(57) ABSTRACT

An adjustable deck shelf assembly has repositionable components to enable the assembly to be secured to variably dimensioned and assembled deck railings. A shelf is secured to a hinged shelf support board with tight dimensional tolerances or with a removable locking shaft in a mechanical interference fit to permit removal and storage of the shelf and assembly. Hinged truss shelf supports secured to support legs can be deployed to support the shelf and retracted for storage. An adjustable deck shelf/seat assembly incorporates variable-height outriggers attached to truss shelf supports and a variable-height shelf support board to enable the assembly to be arranged as a shelf or as a seat. The shelf alternatively may be secured to the deck shelf assembly with slots and hooks.

14 Claims, 24 Drawing Sheets

(56) References Cited

U.S. PATENT DOCUMENTS 1,576,034 A * 3/1926 Butt ..... A47B 5/04 248/240.4
2,170,799 A * 8/1939 Jones ..... A47B 5/04 108/134
3,017,155 A * 1/1962 Scarpetti ..... E04G 5/062 D25/68
3,433,443 A * 3/1969 Beeson ..... A47B 43/00 248/214
4,059,248 A * 11/1977 Kuntz ..... A47H 27/00 248/228.6
4,153,229 A * 5/1979 Bequette ..... E04G 5/06 248/240.3
4,237,661 A * 12/1980 Adams, Sr. ..... E04H 3/126 248/240.4
4,366,673 A * 1/1983 Lapp ..... F15B 11/032 60/482
4,372,425 A * 2/1983 Murphy ..... E04G 5/061 D8/381
4,429,850 A * 2/1984 Weber ..... A47B 96/063 248/250
4,869,378 A * 9/1989 Miller ..... F16M 13/00 248/225.11
4,889,057 A * 12/1989 Chartrand ..... A47B 85/04 108/42
4,893,363 A * 1/1990 Huff ..... E04H 4/144 4/496
4,934,642 A * 6/1990 Baron ..... A47B 96/065 211/90.01
4,949,924 A * 8/1990 Carmody ..... A47H 27/00 248/215
5,009,380 A * 4/1991 Fee ..... F16M 13/022 248/302
5,240,214 A * 8/1993 Birnbaum ..... F16M 11/12 248/214
5,267,715 A * 12/1993 Owen ..... A47G 7/04 248/235
5,303,830 A * 4/1994 Metcalf ..... A47F 5/0807 211/208
5,469,794 A * 11/1995 Laderoute ..... A47B 5/06 108/38
5,485,932 A * 1/1996 Romm ..... H02G 3/28 248/214
5,570,642 A * 11/1996 Lehrman ..... D06F 81/06 248/240.4
5,641,081 A * 6/1997 Merl ..... A47F 5/08 211/106
5,653,178 A * 8/1997 Huczka ..... A47B 96/067 108/135
5,848,711 A * 12/1998 Schmit ..... A47B 96/00 312/246
5,927,840 A * 7/1999 Bzowski ..... E06B 7/28 211/88.01
6,026,932 A * 2/2000 Comp ..... E04G 5/041 248/240.4
6,224,029 B1 * 5/2001 Marble ..... A47B 43/006 248/214
6,230,445 B1 * 5/2001 Arko ..... E04B 2/7416 52/36.5
6,401,944 B1 * 6/2002 Kircher ..... A47B 96/021 108/157.13
6,513,566 B2 * 2/2003 Larin ..... E04F 10/04 182/178.3
6,546,879 B1 * 4/2003 Johnston ..... A47B 96/027 108/47
6,931,998 B1 * 8/2005 Leese ..... A47B 5/02 108/42
7,210,414 B1 * 5/2007 Barone ..... A47B 23/04 108/42
8,267,017 B1 * 9/2012 Michael ..... A47B 5/04 248/240.4
8,376,155 B1 * 2/2013 Olko ..... A47B 45/00 248/240.4
8,418,861 B1 * 4/2013 Weaver ..... A47B 57/20 211/208
8,479,664 B2 * 7/2013 Nelson ..... A47B 5/04 108/42
8,646,624 B2 * 2/2014 Fernandez ..... A47B 57/42 211/90.03
8,915,197 B2 * 12/2014 Raml ..... A47B 37/04 108/42
8,919,585 B2 * 12/2014 Trover ..... A47B 96/02 211/153
8,955,808 B2 * 2/2015 Buschbach ..... F16M 13/02 248/214
9,010,552 B2 * 4/2015 Dart ..... A47F 5/10 211/186
9,661,917 B2 * 5/2017 Dias ..... A47B 13/003
9,814,305 B2 * 11/2017 Brus ..... A47G 7/044
10,362,862 B2 * 7/2019 Symalla ..... A47B 5/02
10,617,209 B1 * 4/2020 Frost ..... A47B 96/021
10,687,616 B2 * 6/2020 Brennan ..... A47B 13/003
11,001,346 B2 * 5/2021 Barwick ..... B63B 29/04
11,125,379 B2 * 9/2021 Thomas ..... E04H 12/22
11,744,366 B2 * 9/2023 Wiggin ..... A47B 57/30 211/187
2003/0052073 A1 * 3/2003 Dix ..... A47G 7/044 211/90.02
2004/0112258 A1 * 6/2004 Fichman ..... A47B 5/04 108/42
2004/0177567 A1 * 9/2004 Braun ..... A47B 81/00 52/79.5
2005/0178059 A1 * 8/2005 Braun ..... A47G 7/044 47/67
2009/0159540 A1 * 6/2009 Meeks ..... F41A 23/18 211/64
2015/0164224 A1 * 6/2015 Kemp ..... A47B 5/02 108/42
2015/0230606 A1 * 8/2015 Mattar ..... F16M 13/02 248/550
2016/0227944 A1 * 8/2016 Gonzalez ..... A47B 96/027
2020/0329866 A1 * 10/2020 Hollingsworth ..... A47B 5/00
2021/0298466 A1 * 9/2021 Ramdass ..... A47B 96/067
2022/0257002 A1 * 8/2022 Williams ..... A47B 13/088
2023/0092850 A1 * 3/2023 Wiggin ..... A47B 5/04 211/187
2023/0407640 A1 * 12/2023 Wiggin ..... A47F 5/0846

* cited by examiner

DECK RAIL SHELF

CROSS-REFERENCE TO RELATED APPLICATIONS

This is a Continuation-In-Part Regular Utility Application of U.S. Regular Utility patent application Ser. No. 17/478,371, filed Sep. 17, 2021, the contents of which are incorporated herein by reference.

FIELD OF THE DISCLOSURE

The disclosure relates to outdoor deck assemblies and more particularly to adjustable and retractable deck shelving. The disclosure further relates to detachable, repositionable and extendable deck shelving and seating.

BACKGROUND OF THE DISCLOSURE

Outdoor decks enable outdoor living. Deck accessories commonly involve metal brackets for attachment of accessories such as shelving, counters, etc., to deck railings or deck platform surfaces. The attachment means can include mechanical fasteners or counterbalanced assemblies that use gravity and friction-fit surfaces to secure accessories. Still other attachment means involve fixed attachments that cannot be repositioned without disassembling the particular accessory.

Deck railing systems come in a wide variety of materials and configurations. Each may have different balusters and railing profiles that each requires specific attachment features for accessories. For example, a three-inch wide handrail will require a differently dimensioned hanging bracket than a four-inch handrail. As a further example, any attachment features secured to balusters will have to accommodate the specific dimensional characteristics of the balusters, e.g., square cross-section, round cross-section, rope balusters, etc. A further difficulty is experienced due to the variability of baluster spacing. For these reasons, most deck accessories have to rely on counter-balanced gravity-driven securement means or fixed attachment via fasteners or adhesives. What is needed and what I have conceived is a releasable and adjustable outdoor deck shelf/seating system that can adjust to any type of handrail, baluster configuration and/or dimensionally different handrails and balusters. These and other objects of the disclosure will become apparent from a reading of the following summary and detailed description of the disclosure.

SUMMARY OF THE DISCLOSURE

In one aspect of the disclosure, an adjustable deck rail shelf assembly includes an upper support board secured to the top ends of first and second support legs. Locking blocks are secured to the upper back sides of the support legs to create slots to receive balusters from a deck railing. The bottoms of the support legs are secured to a lower support board to create a frame. A shelf support board is secured to a pair of hinge blocks via hinges. The hinge blocks are spaced and secured to a bottom of the upper support board. The hinges enable the shelf support board to rotate between an operational/upright position and a retracted/storage position.

To maintain the shelf support board in an upright/operational position, a pair of stationary or hinged truss supports are each secured to a dedicated support leg. When the shelf support board is placed in the upright position, the truss supports are rotated (if hinged) below the shelf support board in a substantially orthogonal orientation to the shelf support board to create two support surfaces for the shelf support board. Once the truss supports are in position, the shelf support board is allowed to register against the tops of the truss supports.

Once the truss supports and shelf support board are in an operational position, a removable shelf is secured to the shelf support board via a complimentary set of slots and shoulders. If the sets of slots and shoulders are not tightly dimensioned to essentially create a friction fit or similar engagement means, a locking shaft is inserted into a gap formed between the registration surfaces of the shelf support board and the locking shelf to secure the connection between the two components. To break down the assembly, the assembly steps are reversed and the components are returned to their storage positions.

In a further aspect of the disclosure, a deck rail shelf assembly has support board formed with two or more hook-engaging slots to receive a shelf. The shelf is formed or provided with two or more shelf hooks that each correspond to one of the two or more hook-engaging slots. The combination of shelf hooks and hook-engaging slots permit the shelf to be releasably locked to the support board particularly and the deck rail assembly generally.

In another aspect of the disclosure, an adjustable deck shelf/seat assembly includes adjustable-height components to permit the assembly to function as either a shelf or a seat. The deck shelf/seat assembly includes an upper support board secured to the top ends of first and second support legs. Locking blocks are secured to the upper back sides of the support legs to create slots to receive balusters from a deck railing. The bottoms of the support legs are secured to a lower support board to create a frame. A height-variable secondary upper support board is secured to the support legs below the upper support board. A height-adjustable shelf support board is secured to a pair of hinge blocks via hinges. The hinge blocks are spaced and secured to a bottom of the secondary upper support board. The hinges enable the shelf support board to rotate between an operational/upright position and a retracted/storage position. Multiple through-bores or sets of through-bores formed on the support legs allow for the adjustability of the height of the secondary upper support board and the height-adjustable shelf support board secured to the secondary upper support board.

To maintain the height-adjustable shelf support board in an upright/operational position, a pair of height-variable outrigger sleeves and hinged truss support subassemblies are each secured to a dedicated support leg. When the height-adjustable shelf support board is placed in the upright position, the variable-height truss supports are rotated below the shelf support board in a substantially orthogonal orientation to the shelf support board to create two support surfaces for the shelf support board. Once the variable-height truss supports are in position, the height-adjustable shelf support board is allowed to register against the tops of the variable-height truss supports.

Once the variable-height truss supports and shelf support board are in an operational position, a removable shelf or seat, depending upon the set height of the shelf support board, is secured to the shelf support board via a complimentary set of slots and shoulders. A locking shaft is inserted into a gap formed between the registration surfaces of the shelf support board and the locking shelf to secure the connection between the two components. To break down the assembly, the assembly steps are reversed and the components are returned to their storage positions. The slots and locking shaft can be formed in a multitude of complimentary cross-sectional geometric shapes to further enhance the releasably locking function of the features. These and other aspects of the disclosure will become apparent from a review of the appended drawings and a reading of the following detailed description of the disclosure.

DETAILED DESCRIPTION OF THE DISCLOSURE

I. Deck Shelf Assembly

Figure 1:
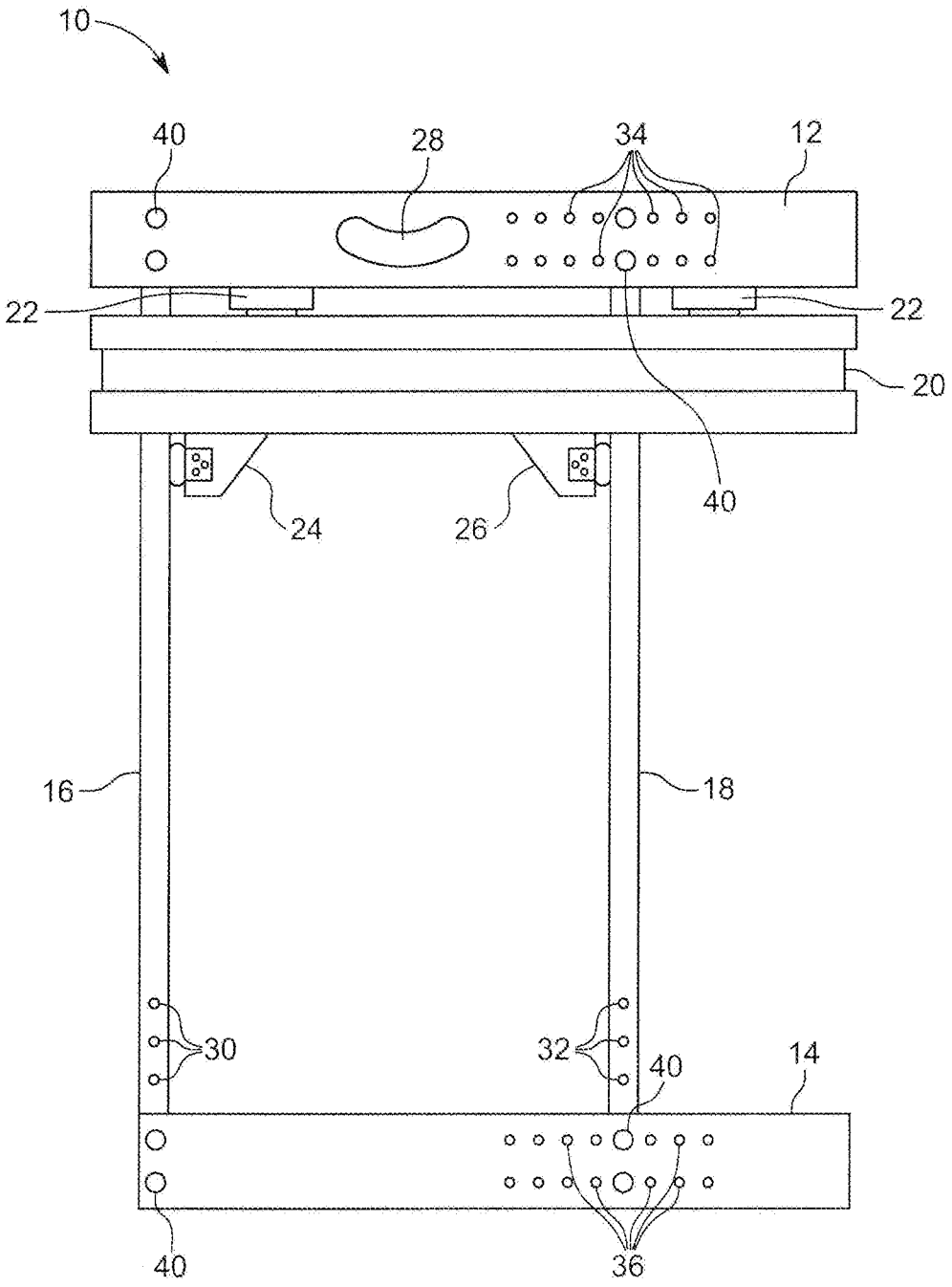
FIG. 1 is a front view in elevation of an adjustable deck shelf assembly according to one embodiment of the disclosure.

Referring now to FIGS. 1-4*b*, in one aspect of the disclosure, a modular, adjustable and storable deck shelf assembly, designated generally as 10, is formed from a series of components to enable the assembly to be secured to a deck railing and adjusted into an operable position. Deck shelf assembly 10 also may be removed from a deck railing and adjusted for storage. Deck shelf assembly 10 includes a horizontal upper support board 12. Upper support board 12 is formed with a pair of vertically-oriented first-leg through-bores 15 (shown in FIG. 4*a*) proximal a first end and dimensioned to receive mechanical fasteners. A first support leg 16 is formed with a pair of vertically-oriented, first support leg upper through-bores 17 (not shown), proximal a top end of the support leg, dimensioned and spaced to align with through-bores 15 of upper support board 12.

A pair of mechanical fasteners 40, e.g., lag bolts and/or bolt/washer/nut combinations, are each inserted into each pair of aligned through-bores 15 and 17 in upper support board 12 and support leg 16, respectively, and secured with nuts 46 to secure the top end of support leg 16 to upper support board 12. Once attached, the orientation of support leg 16 to upper support board 12 is substantially orthogonal and fixed. Other alignment orientations of the support leg to the upper support board are possible and remain within the scope of the disclosure as disclosed in more detail herein. It should be understood that a plurality of first-leg through-bores 15 may be formed in upper support board 12 to vary the lateral orientation of first support leg 16 to upper support board 12.

Formed on a right side of upper support board 12 is a plurality of second-leg through-bores 34. Through-bores 34 are substantially equally spaced and arranged in a pair of substantially parallel through-bore lines. At least one pair of vertically-aligned second-leg through bores 34 are needed. The arrangement permits a second support leg 18 to be secured to support board 12 with mechanical fasteners 40. A pair of corresponding second support leg upper through-bores 19 (not shown) are formed proximal a top end of second support leg 18 and spaced vertically to align with the spacing of the parallel lines of through-bores 34. To set the horizontal distance between first support leg 16 and second support leg 18, a column of second-leg through-bores 34 are selected and aligned with second support leg upper through-bores 19 and secured with mechanical fasteners 40. The spacing of the columns of through-bores 34 set the defined horizontal distances possible between the two support legs. It should be understood that the number of columns of second-leg through-bores 34 can be varied and remain within the scope of the disclosure.

Support board 12 may be formed with an optional hand-grip bore 28. Hand-grip bore 28, if provided, may be shaped to conform to a closed hand with radiused edges to provide a comfortable grip for lifting and manipulating deck shelf assembly 10. Alternatively, two spaced hand-grip bores (not shown) may be incorporated into support board 12 to facilitate two-hand manipulation of the assembly.

To secure the top end of the deck shelf assembly 10 to a deck rail, a pair of locking blocks are secured to the support legs. Secured to the top, back side of first support leg 16 is a first upper locking block 44. First upper locking block 44 is dimensioned to be wider than first support leg 16 to create a hook-like feature with the portion of the locking block that extends beyond the side of the support leg. The combination of the first support leg side and the extended portion of the locking block creates a slot for receiving a deck rail baluster. A pair of vertically-aligned first locking block through-bores 45 (not shown) are dimensioned and spaced to align with first-leg through-bores 15 and first support leg upper through-bores 17. The same mechanical fasteners 40 used to secure upper support board 12 to first support leg 16 are used to secure first locking block 44 to the back side of upper support board 12 via first locking block through-bores 45. The size, i.e., the thickness and length, of mechanical fasteners 40 can be varied to accommodate the different thicknesses and dimensions of the deck shelf assembly 10 components secured together with the fasteners.

Secured to the top, back side of second support leg 18 is a second upper locking block 42. Second upper locking block 42 is dimensioned to be wider than second support leg 18 to create a second slot with the portion of the locking block that extends beyond the side of the second support leg. The combination of the second support leg side and the extended portion of the second locking block creates a second slot for receiving a second deck rail baluster. A pair of vertically-aligned second locking block through-bores 43 (not shown) are dimensioned and spaced to align with second-leg through-bores 34 and second support leg upper through-bores 19. The same mechanical fasteners 40 used to secure upper support board 12 to second support leg 18 are used to secure second locking block 44 to the back side of upper support board 12.

Figure 2:
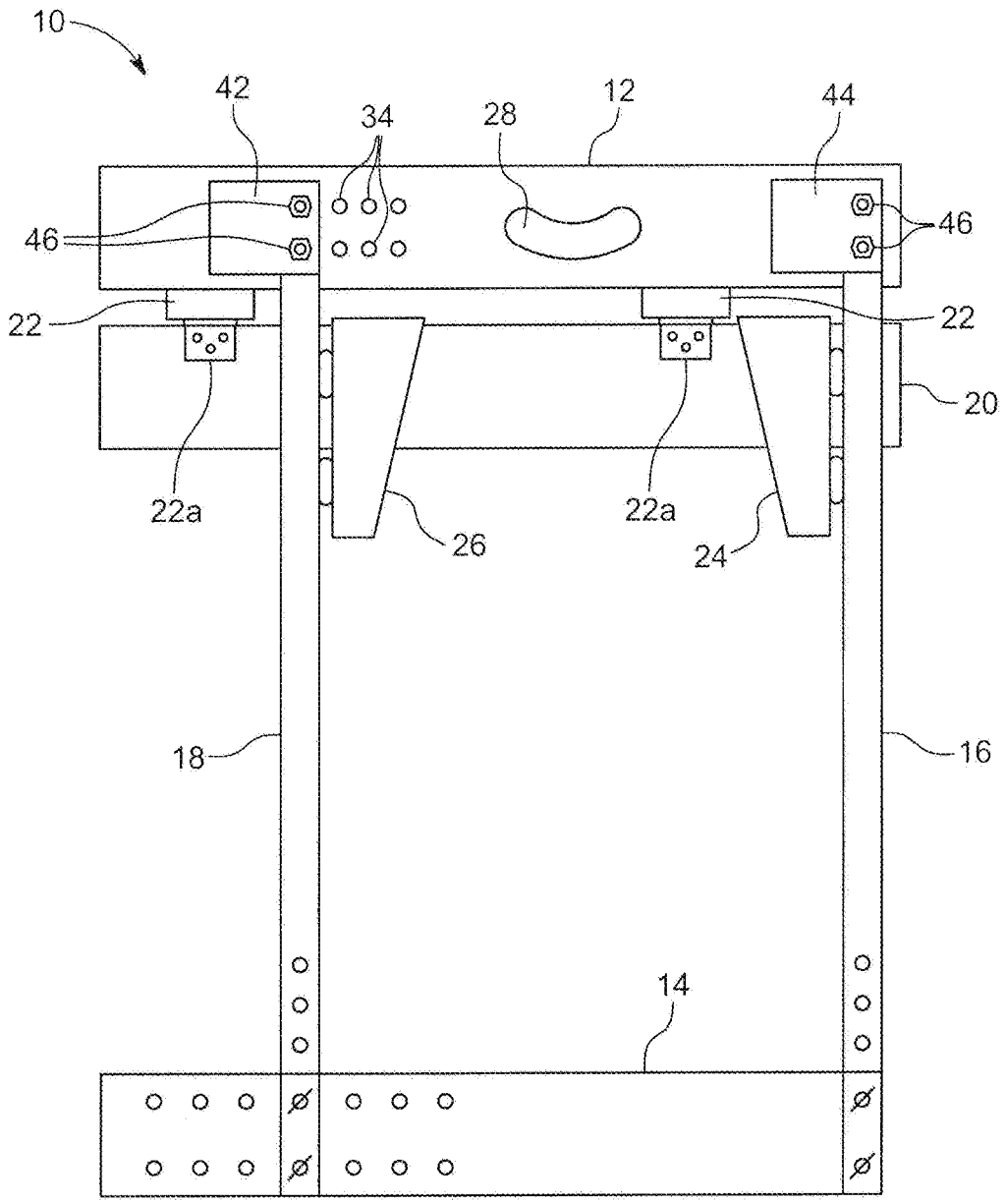
FIG. 2 is a back view in elevation of the adjustable deck shelf assembly shown in FIG. 1.
Figure 29:
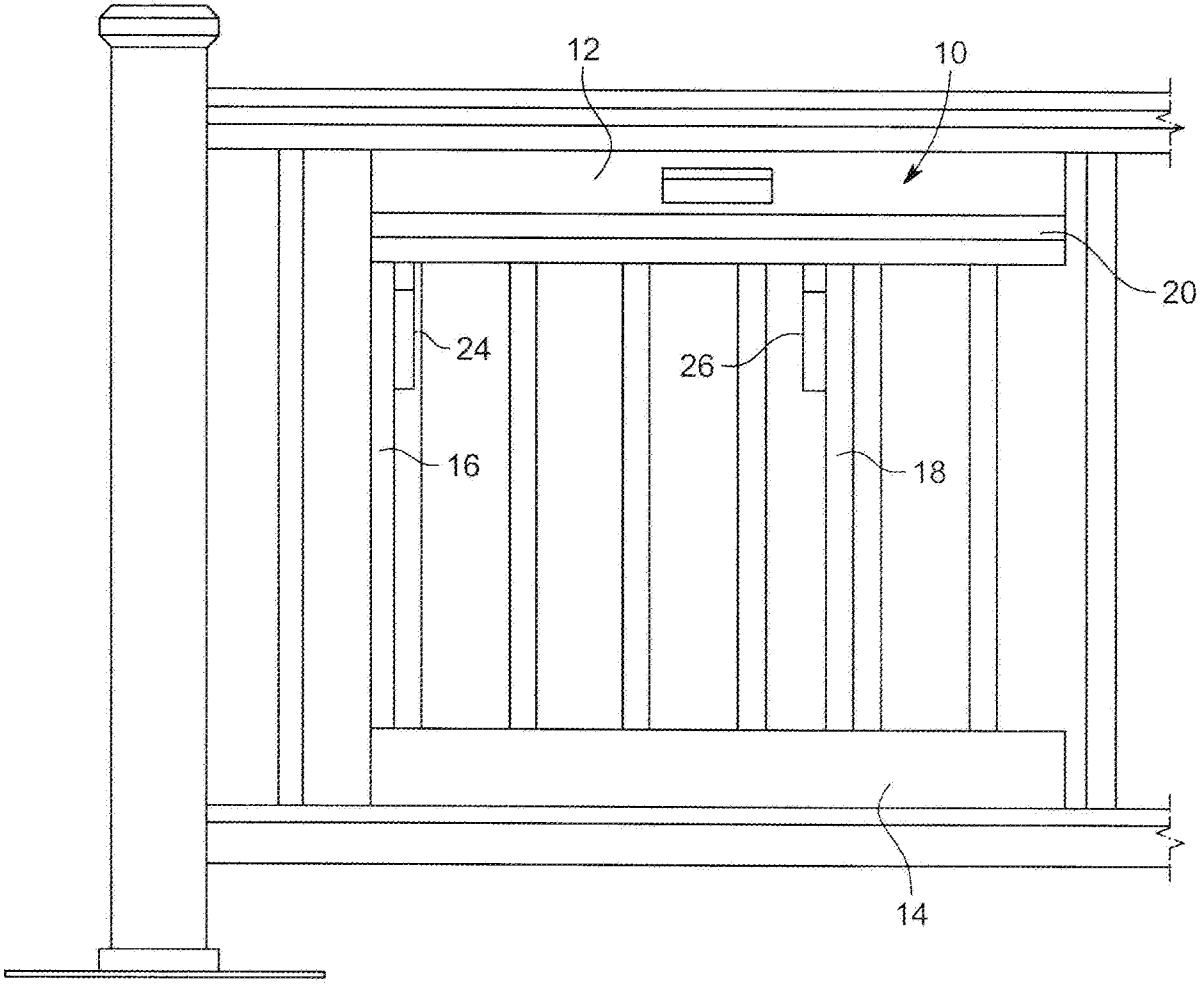
FIG. 29 is a front view in elevation of an adjustable deck shelf assembly secured to a deck railing according to one embodiment of the disclosure.
Figure 32:
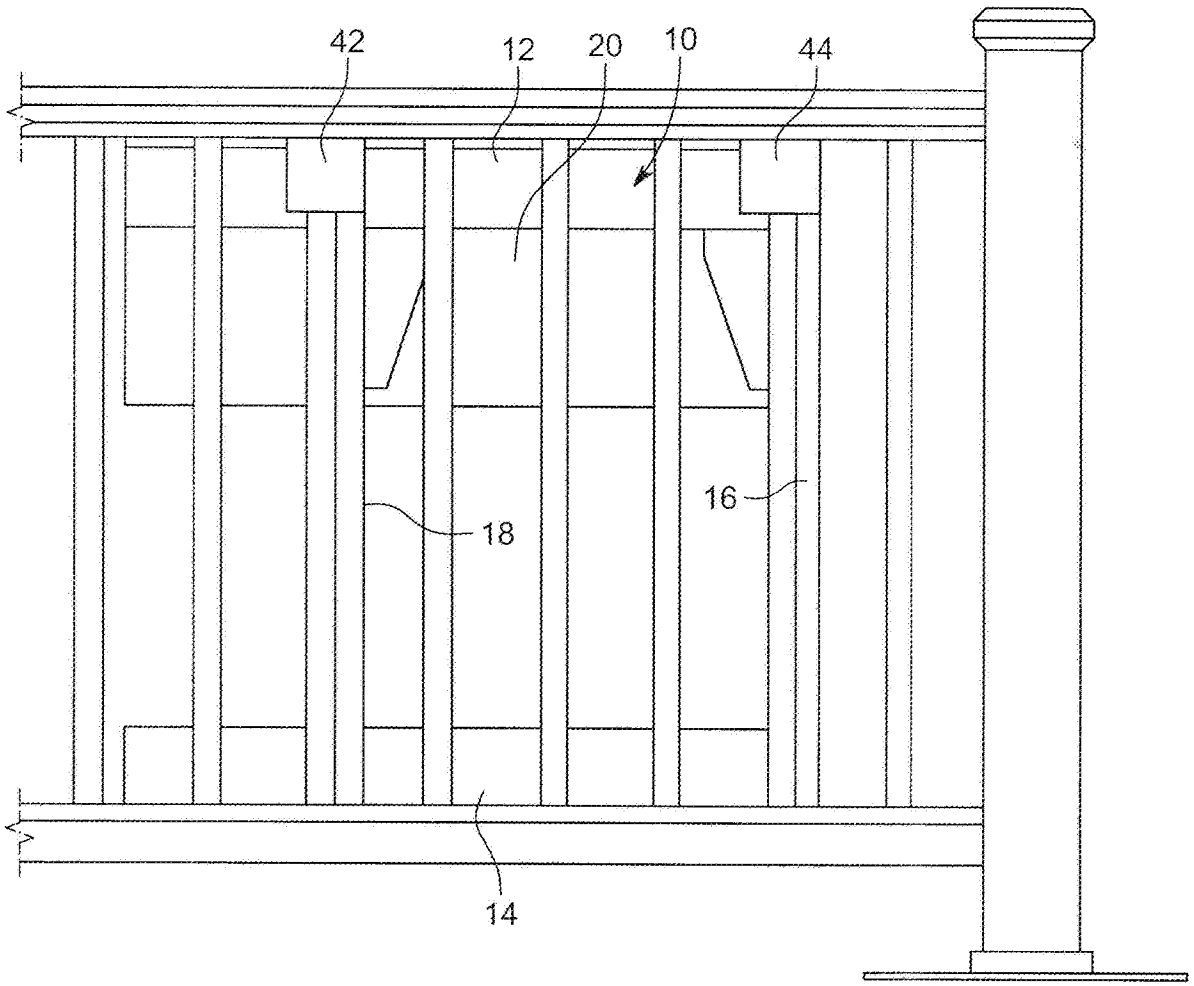
FIG. 32 is a side view in elevation of the adjustable deck shelf assembly secured to a deck railing shown in FIG. 29 with the shelf-support board in a down or storage position.
Figure 31:
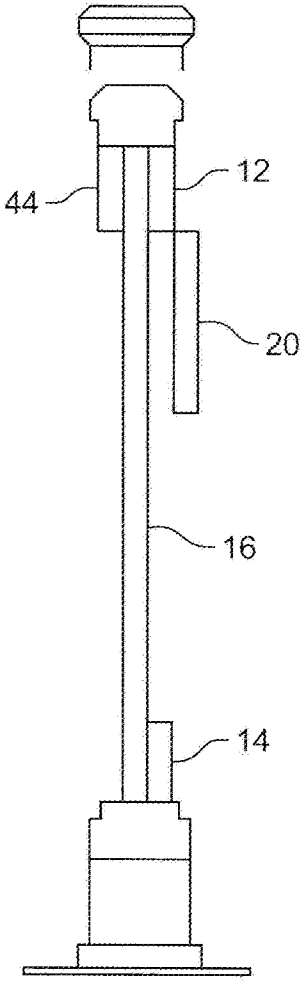
FIG. 31 is a back view in elevation of the adjustable deck shelf assembly secured to a deck railing shown in FIG. 29.
Figure 33:
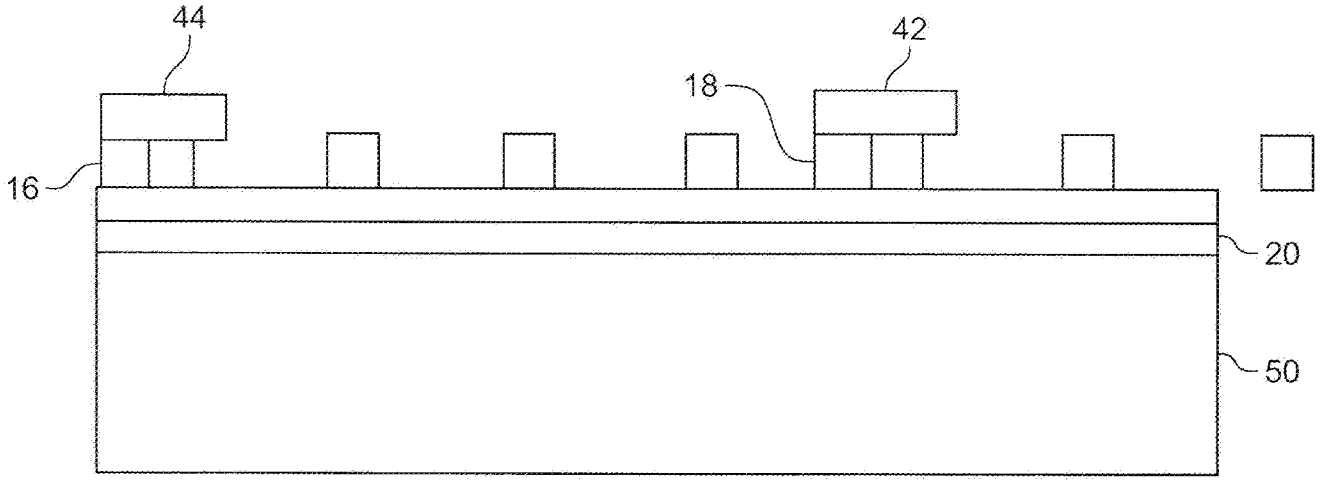
FIG. 33 is a top view of the adjustable deck shelf assembly secured to a deck railing shown in FIG. 29 with the shelf support board in an up or operational position.
Figure 34:
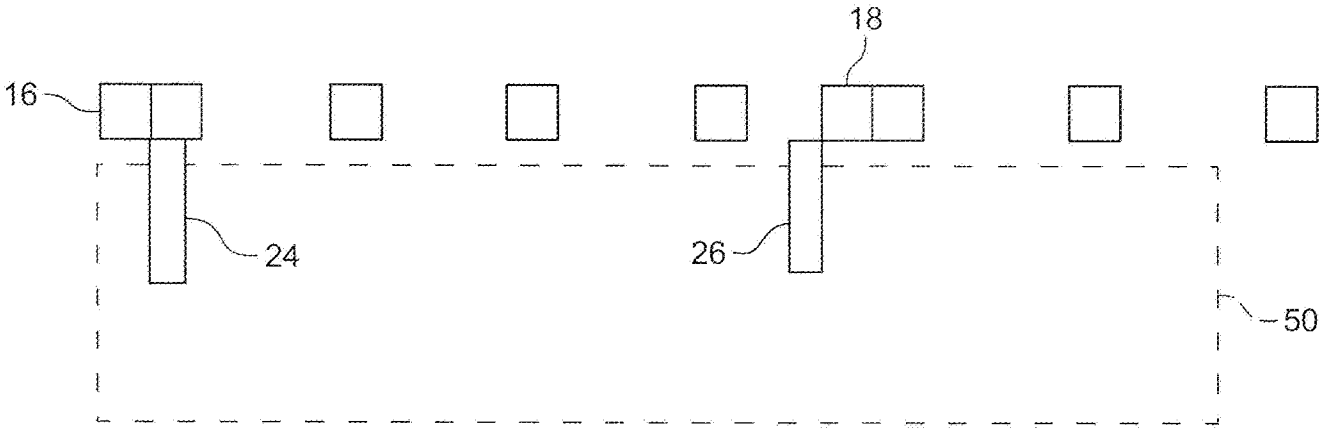
FIG. 34 is a top sectional view in partial phantom of the adjustable deck shelf assembly attached to a deck railing shown in FIG. 29 showing the hinged shelf supports in the operational position.
Figure 35:
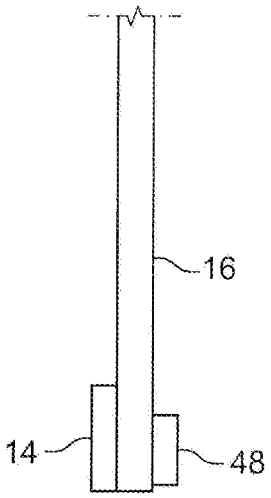
FIG. 35 is a front, partial sectional view of a bottom end of a first support leg with a laterally-extending lower first-leg locking block according to yet another embodiment of the disclosure.
Figure 36:
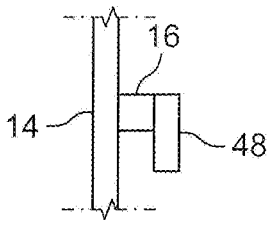
FIG. 36 is a top, partial sectional view of the first support leg and lower first-leg locking block assembly shown in FIG. 35.
Figure 37:
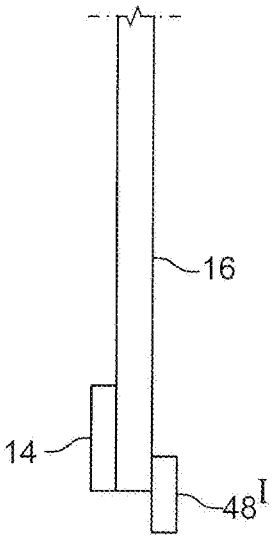
FIG. 37 is a front, partial sectional view of a bottom end of a first support leg with a downwardly-extending lower first-leg locking block according to still another embodiment of the disclosure.
Figure 38:
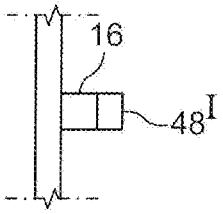
FIG. 38 is a top, partial sectional view of the first support leg and downwardly-extending lower first-leg locking block assembly shown in FIG. 37.
Figure 39:
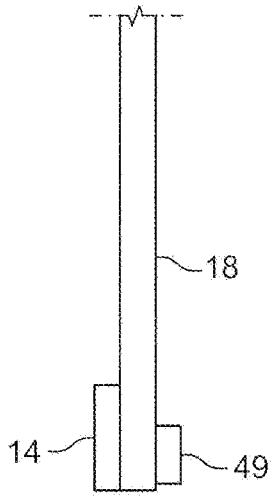
FIG. 39 is a front, partial sectional view of a bottom end of a second support leg with a laterally-extending lower second-leg locking block according to a further embodiment of the disclosure.
Figure 40:
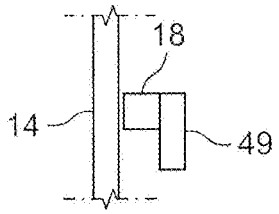
FIG. 40 is a top, partial sectional view of the second support leg and laterally-extending lower second-leg locking block assembly shown in FIG. 39.
Figure 41:
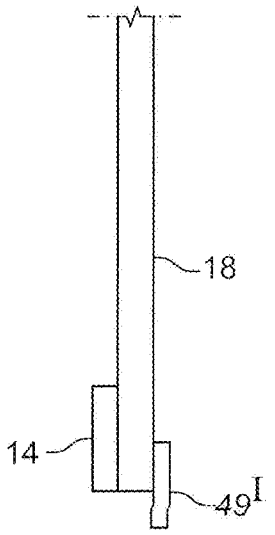
FIG. 41 is a front, partial sectional view of a bottom end of a second support leg with a downwardly-extending lower second-leg locking block according to a yet further embodiment of the disclosure.
Figure 42:
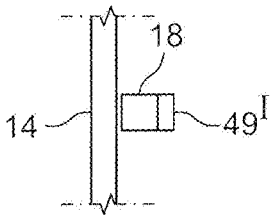
FIG. 42 is a top, partial sectional view of the second support leg and downwardly-extending lower second-leg locking block assembly shown in FIG. 41.

In the embodiment shown in FIG. 2, first locking block 44 and second locking block 42 create slots facing the same direction. This enables deck shelf assembly 10 to be secured to a deck railing by aligning the locking blocks between balusters and shifting assembly 10 in the direction of the slots to engage balusters with the slots as shown in FIGS. 31 and 33. This sets the relative horizontal alignment of deck shelf assembly 10 to the deck railing as shown in FIGS. 29, 31 and 33. In the embodiment shown in FIG. 7, the locking blocks are positioned so the slots formed by the locking blocks do not face the same direction but face each other. For this embodiment, one of the locking blocks has to be pivoted by removing one mechanical fastener so the locking block does not create a slot and hook a baluster while the other fixed locking block hooks a baluster via the side translational movement of assembly 10. Once assembly 10 has been aligned with the deck railing, the loosened locking block is pivoted back into position and secured with the mechanical fastener that was removed previously.

To secure the bottom ends of the first and second support legs, a lower support board 14 is formed with a series of through-bore sets to enable support board 14 to be secured to the support legs via mechanical fasteners 40. With respect to first support leg 16, a pair of vertically-oriented lower support board first-leg through-bores 35 (shown in FIG. 4*b*) are formed proximal a left end of lower support board 14. One or more pairs of first support leg lower through-bores 30 are formed at a lower end of first support leg 16 and are spaced to align with the spacing of through-bores 35. If only one pair of second support leg lower through-bores 30 are used, the height of lower support board 14 will be oriented in a fixed position relative to upper support board 12. Likewise, the horizontal orientation of first support leg 16 to lower support board 14 will be fixed. For purposes of this disclosure, it should be understood that any two components secured together in a spatially fixed relationship may be secured using means other than mechanical fasteners such as adhesives and remain within the scope of the disclosure.

Lower support board 14 may be further modified to vary the horizontal or lateral orientation of first support leg 16 to the support board. To accomplish this, more than one pair of vertically-oriented lower support board first-leg through-bores 35 are included in a pair of substantially parallel rows, in the same manner as the plurality of second-leg through-bores 34 in upper support board 12. It should be understood that the vertical and horizontal orientation of first support leg 16 to the upper and lower support boards may be made variable by adding additional columns of substantially parallel first-leg through-bore sets in the upper and lower support boards as well as additional through-bores in first support leg 16.

With respect to second support leg 18, formed proximal a right side of lower support board 14 is a plurality of lower support board second-leg lower through-bores 36. Lower through-bores 36 are substantially equally spaced and arranged in a pair of vertically-oriented, substantially parallel through-bore rows. Each through-bore 36 of one row is vertically aligned with a through-bore 36 of the second row. At least one pair of vertically-aligned through-bores 36 are needed. This ensures orthogonal alignment of the support leg relative to the lower support board. The arrangement permits a lower end of second support leg 18 to be secured to lower support board 14 with mechanical fasteners 40. One or more pairs of corresponding, vertically-aligned, lower second support leg through-bores 32 are formed proximal a bottom end of second support leg 18 and spaced vertically to align with the spacing of the parallel lines of through-bores 34. Second support leg 18 may be formed with a single pair of vertically-aligned, second support leg lower through-bores 32 to create a fixed vertical orientation of the second support leg to lower support board 14. By including additional pairs of through-bores 32, the height of lower support board 14 relative to second support leg 18 and upper support board 12 can be adjusted to accommodate a specific railing height.

It should be understood that the orthogonal alignment of the support legs to the upper and lower support boards can be modified to adapt the deck rail shelf assembly to a particular deck railing configuration in which the balusters may be offset from a 90° alignment and remain within the scope of the disclosure. In such a configuration, the support legs can be oriented to the upper and lower support boards at an angle to match the angle of the railing balusters. This can be accomplished by realigning pairs of the vertically-oriented second-leg lower through-bores 36 to be offset at an angle that matches the angle of the subject balusters. In this configuration, the upper and lower support boards will remain in a substantially parallel orientation regardless of the support leg angular orientations to maintain alignment with the railing to which the assembly is secured. Similar adjustments can be made to the through-bores to match the angular orientation of, for example, a stair railing.

Figure 5:
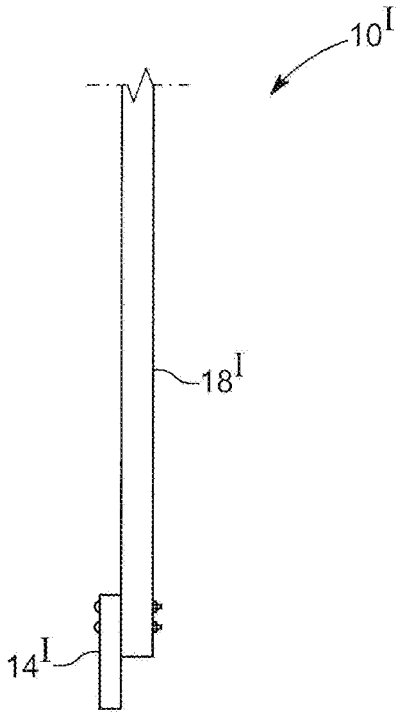
FIG. 5 is a partial side view in elevation of a deck shelf assembly support leg and lower support board subassembly according to another embodiment of the disclosure.

To accommodate different spatial orientations of the bottom rails and balusters of railing systems, modifications can be made to the orientation of lower support board 14 relative to the support legs. As shown in FIG. 5, in another embodiment of the disclosure, a deck shelf assembly, designated generally as 10', has a lower support board 14' offset from the lower ends of the support legs such as a second support leg 18'. As used herein, identical reference characters having differently primed or unprimed variations and assigned to features of the disclosure are intended to identify different embodiments of the same feature. The offset of support board 14' is accomplished by biasing a plurality of second-leg lower through-bores (not shown), similar to second-leg lower through-bores 36, toward the upper edge of lower support board 14'.

When lower support board 14' is secured to second support leg 18' and a first support leg (not shown), a gap is formed on the back side of the lower support board with the upper end of the gap defined by the bottom end of the support legs, such as second-support leg 18' as shown. This enables lower support board 14' to register directly against a lower rail of a railing system while the bottom ends of the support legs register against a top surface of the lower rail to provide a large surface area of support rather than have the lower support board register against the balusters of the rail system. This configuration is especially advantageous when the face of the lower rail of a railing system is aligned with the faces of the balusters to which the assembly 10' is secured. The support legs of assembly 10' will register against the sides of the balusters and the top of the lower rail, and the lower support board will register directly against the lower railing.

Figure 6:
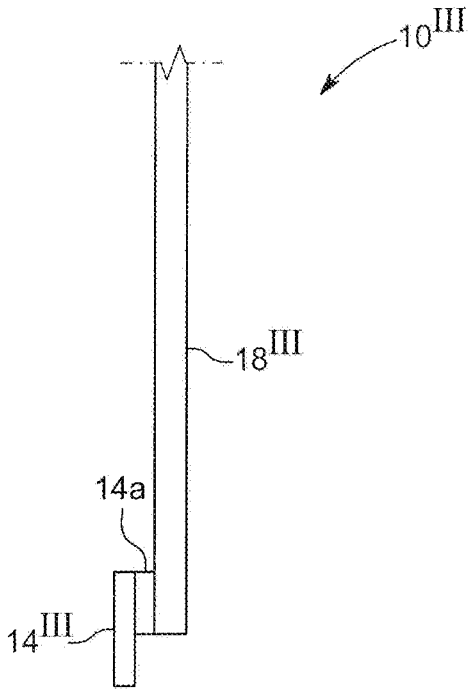
FIG. 6 is a partial side view in elevation of a deck shelf assembly support leg, spacer block and lower support board subassembly according to yet another embodiment of the disclosure.

In a yet further embodiment of the disclosure, a spacer block 14*a* is used to further offset a lower support board from support legs of a deck shelf assembly. As shown in FIG. 6, a deck shelf assembly, designated generally as 10''', has a lower support board 14''' offset from the lower ends of the support legs such as a second support leg 18''' with spacer block 14*a*. The offset of support board 14''' is again accomplished by biasing a plurality of second-leg lower through-bores (not shown), similar to second-leg lower through-bores 36, toward the upper edge of lower support board 14'''.

When lower support board 14''' is secured to second support leg 18''' with spacer block 14*a* sandwiched between the lower support board and each of the support legs, a relatively large gap is formed on the back side of the lower support board with the upper end of the gap defined by the bottom end of the support legs and the bottom edge of the spacer block. For purposes of this embodiment, one spacer block 14*a* can be used for each support leg or a single spacer block 14*a* can be used that extends the distance between the most distant edges of the support legs, such as second-support leg 18''' as shown. Like the embodiment shown in FIG. 5, this enables lower support board 14''' to register directly against a lower rail of a railing system to provide a large surface area of support rather than register against the balusters of the rail system. This configuration is especially advantageous when the face of the lower rail of a railing system is proud of, or extends outwardly from, the faces of the balusters to which the assembly 10''' is secured. The support legs of assembly 10''' will register against the sides of the balusters and the top surface of the lower rail and the lower support board will register directly against the face or outer edge of the lower rail.

In a further alternative embodiment as shown in FIGS. 35-42, one or more lower locking blocks may be secured to the lower ends of the support legs to releasably "lock" the lower end of the deck shelf assembly 10 to a deck or other rail system. In this embodiment, a first-leg lower locking block 48 is secured to a back, bottom end of first leg 16. A second-leg lower locking block 49 is secured to a back, bottom end of second leg 18. In one sub-embodiment shown in FIGS. 35, 36, 39 and 40, locking blocks 48 and 49 are a first-leg, laterally-extending lower locking block 48 and a second-leg, laterally-extending lower locking block 49, respectively, that extend laterally from their respective support legs to form a square "U-shaped" opening to capture and secure a deck rail baluster. If this sub-embodiment is used, to secure the deck shelf assembly 10 to a deck railing, the assembly 10 is inserted into the spacing between deck rail balusters and shifted laterally so the upper and lower locking blocks register against balusters to releasably lock assembly 10 to the deck rail. To remove assembly 10 from the deck rail, the installation process steps are performed in the reverse order.

In another sub-embodiment shown in FIGS. 37, 38, 41 and 42, a first-leg downwardly-extending lower locking block 48' is secured to a back, bottom end of first leg 16. A second-leg laterally-extending lower locking block 49' is secured to a back, bottom end of second leg 18. Unlike lower locking blocks 48 and 49, lower locking blocks 48' and 49' extend downwardly from the bottom ends of their respective support legs to form an "L-shaped" opening with the bottom ends of the support legs. Rather than capture and be secured to a deck rail baluster, lower locking blocks 48' and 49' register against a back end of a deck rail lower rail. If this sub-embodiment is used, to secure the deck shelf assembly 10 to a deck railing, the assembly 10 is inserted into the spacing between deck rail balusters at an angle with the lower end of the assembly leading. Assembly 10 is then rotated into an upright position and shifted laterally so the upper locking blocks register against balusters to releasably lock assembly 10 to the balusters and lower deck rail. To remove assembly 10 from the deck rail, the installation process steps are performed in the reverse order. It should be understood that only one lower locking block, 48, 48', 49, 49', may be used to lock the lower end of deck shelf assembly 10 to a deck rail. Embodiments without any lower locking blocks also are within the scope of the disclosure.

Referring again to FIGS. 1 and 2, secured to a bottom edge of upper support board 12 are two or more hinge blocks 22 each used to support a hinge 22*a*. One plate of each hinge 22*a* is secured to a front face of one hinge block 22. A second plate of each hinge 22*a* is secured to a bottom or back surface of a shelf-support board 20. The hinge plates are held together with pins secured in the hinge plate knuckles as is commonly known in the art. Shelf support board 20 is elongate and may have substantially the same length as upper support board 12. It should be understood that the length of shelf support board 20 can be varied relative to upper support board 12 and remain within the scope of the disclosure.

Referring now to FIGS. 1, 2 and 7-10, shelf support board 20, in one embodiment, is formed with a shelf-support slot 23 in its front face. Shelf-support slot 23 may extend the entire width of shelf support board 20 or may extend over only a partial segment of shelf support board 20. For the purpose of clarity, the front face 20*a* of shelf support board 20 is the surface of the board that faces out from a front side of the overall assembly 10 when the shelf support board is in a down or storage position. A top edge 20*b* of shelf support board 20 is the surface that faces the hinge blocks 22 when the shelf support board is in a storage position. When the shelf support board is in an up or operational position, front face 20*a* is now a top surface of the shelf support board. Positioning shelf support board 20 in an up or down position is accomplished by rotating the shelf support board about the hinge pins.

Figure 10:
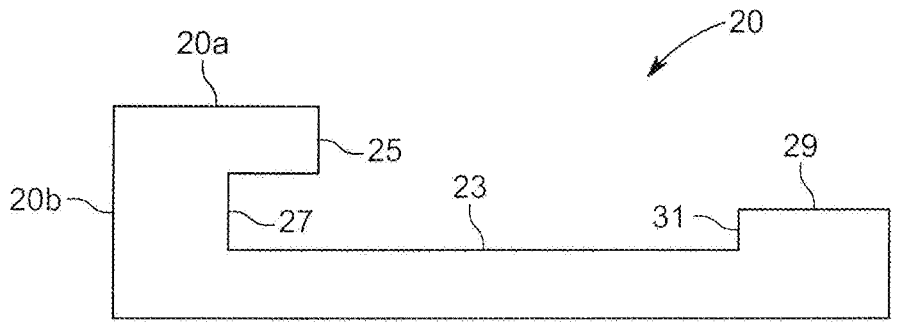
FIG. 10 is an end view of the shelf support board shown in FIG. 9.

As shown particularly in FIG. 10, the width or height (depending upon the support shelf's orientation) of shelf-support slot 23 is defined by an upper slot shoulder 27 and a lower slot shoulder 31. An overhang 25 extends toward a center line of shelf support board 20 from a top edge of shelf support board 20 and forms an elongate cove in conjunction with upper slot shoulder 27. A shelf support board bottom end 29 of shelf support board 20 has a reduced thickness relative to the thickness of shelf support board 20 at the top end 20*b* of the board. As disclosed in more detail herein, shelf support board bottom end 29 functions as a cantilever support surface for a shelf 50.

To secure shelf support board 20 in an up or operational position, a pair of retractable truss shelf supports are provided. As shown more particularly in FIG. 2, A first truss shelf support 24 is secured to first support leg 16 with a first pair of hinges, each positioned proximal an upper or lower end of first truss shelf support 24. A second truss shelf support 26 is secured to second support leg 18 with a second pair of hinges, each positioned proximal an upper or lower end of second truss support 26. As shown, the truss shelf supports are substantially triangular in shape with a wider surface at the top relative to the bottom of the truss shelf supports. It should be understood that the length of the top surface of the truss shelf supports are dimensioned to register against a substantial portion if not the entire dimension of the top-to-bottom width of shelf support board 20. It should be further understood that the overall shape of the truss shelf supports can be varied and remain within the scope of the disclosure as long as the top dimension of the truss shelf support register against a substantial portion of the width of shelf support board 20, which can be, illustratively, at least 75% of the width.

Figure 7:
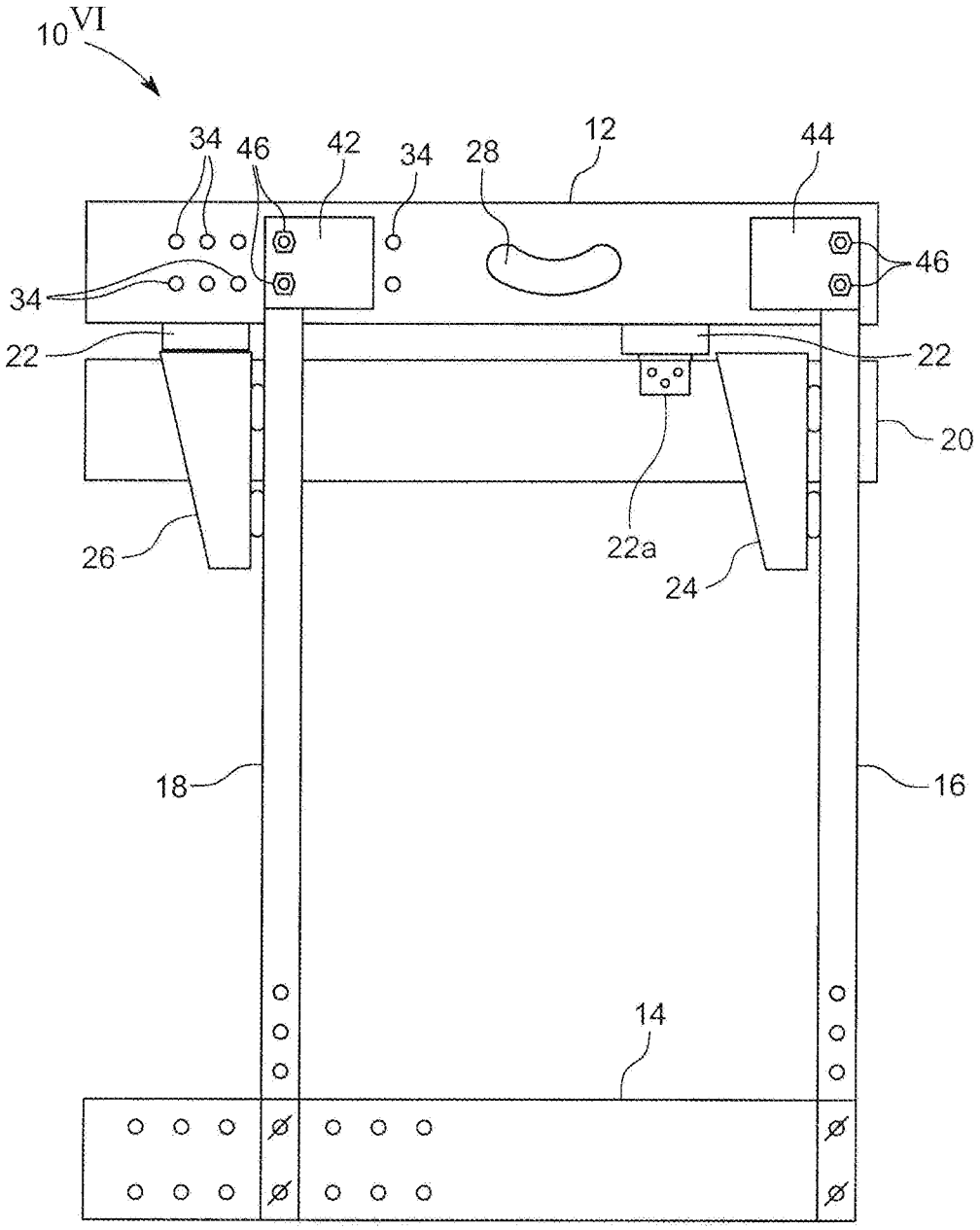
FIG. 7 is a back view in elevation of the adjustable deck shelf assembly with upper locking blocks facing inwardly according to still another embodiment of the disclosure.
Figure 8:
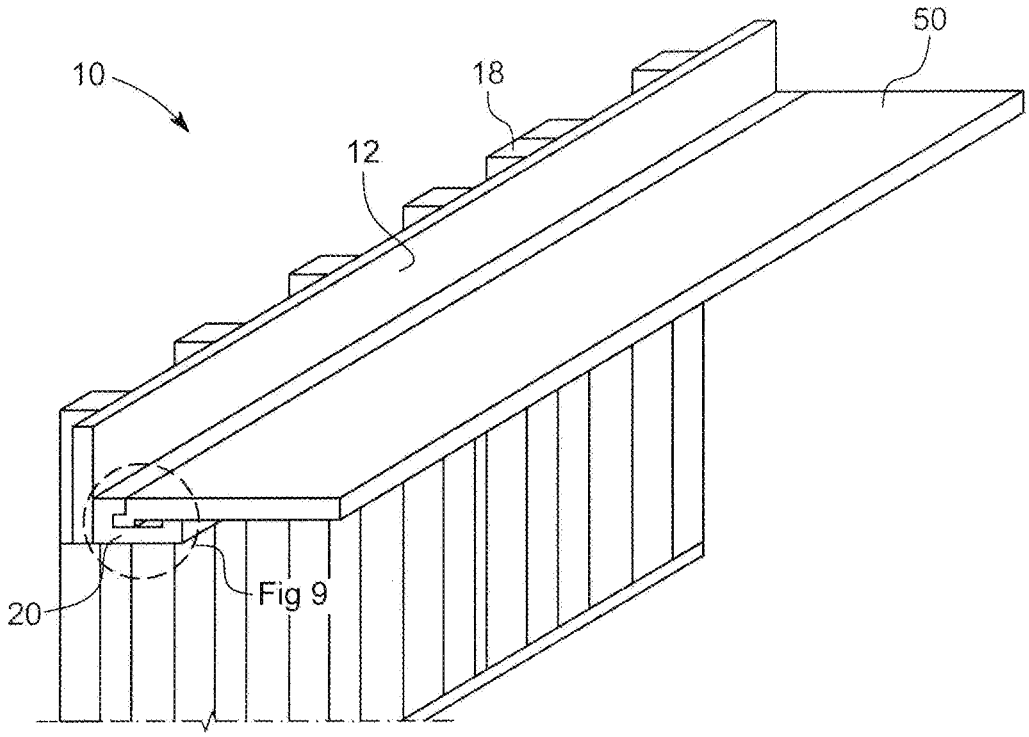
FIG. 8 is a top, end perspective view of the adjustable deck shelf assembly shown in FIG. 1 with a removable shelf employed in an upright position.
Figure 9:
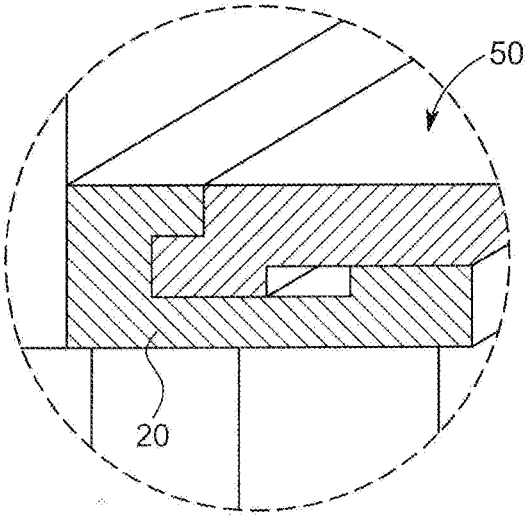
FIG. 9 is a top, end perspective view of a shelf support board/shelf support subassembly according to the embodiment of the disclosure shown in FIG. 1.

To position truss shelf supports 24 and 26 in a closed or storage position, the truss shelf supports are rotated on their hinges so the faces of the truss shelf supports are positioned along a plane occupied by the two support legs. In FIG. 2, the truss shelf supports face each other in a closed or storage position. In FIG. 7, a deck shelf assembly, designated generally as $\mathbf{10}^{VT}$, has the truss shelf supports 24 and 26 facing the same direction when in a closed or storage position. This is accomplished by securing each of the truss shelf supports via hinges to the same left or right side of the respective support legs to which the truss shelf supports are attached.

Figure 3A:
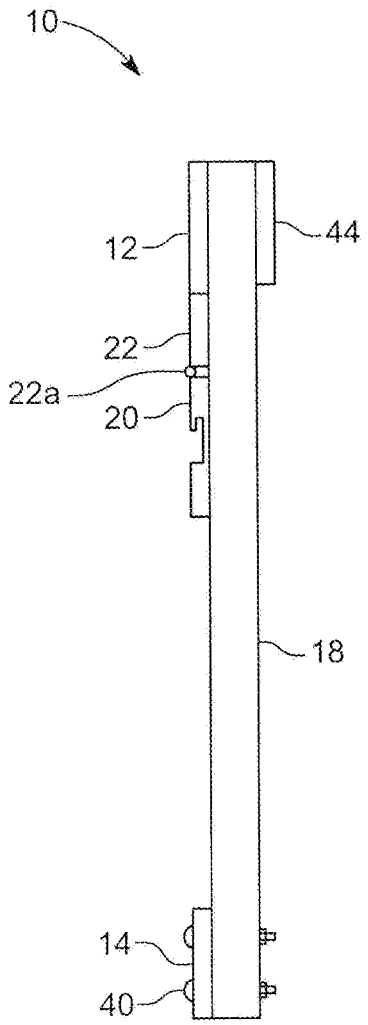
FIG. 3*a* is a side view in elevation of the deck shelf assembly shown in FIG. 1 in a retracted/stored configuration.
Figure 3B:
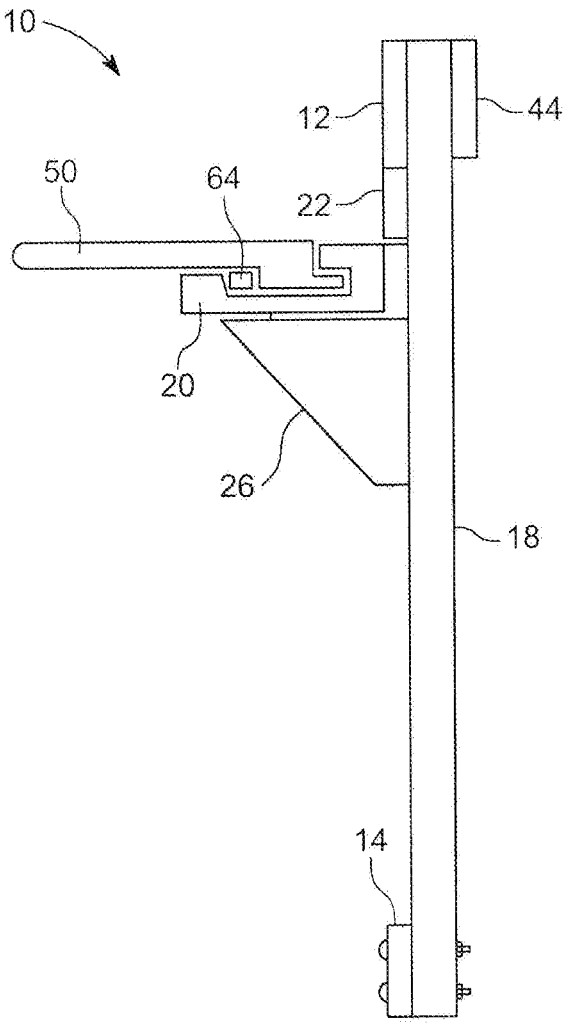
FIG. 3*b* is a side view in elevation of the deck assembly shown in FIG. 1 in an operational configuration.
Figure 4A:
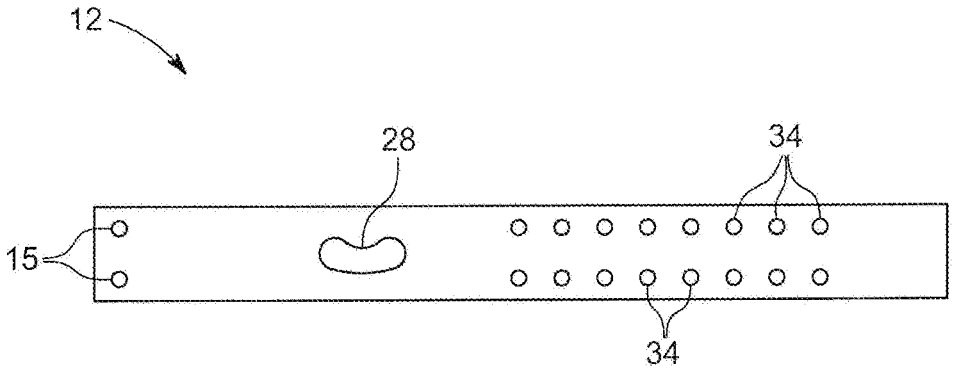
FIG. 4*a* is a front view of an upper support board according to the embodiment of the disclosure shown in FIG. 1.
Figure 4B:
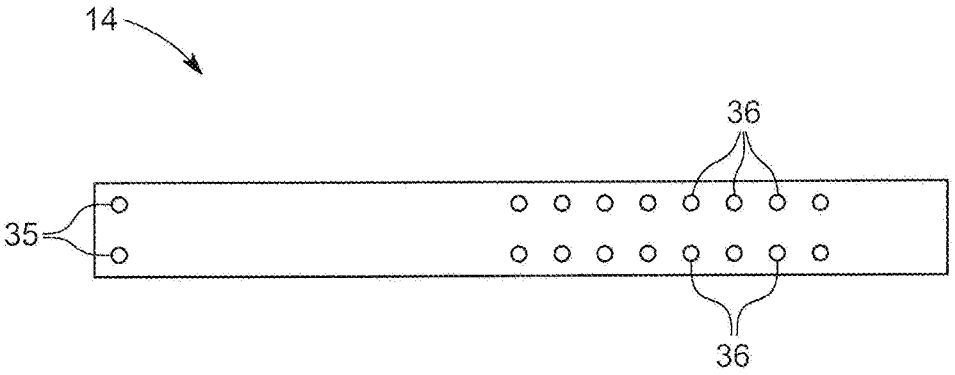
FIG. 4*b* is a front view of a lower support board according to the embodiment of the disclosure shown in FIG. 1.

To position the truss shelf supports in an operational position and support shelf support board 20 and a shelf 50 disclosed in more detail herein, shelf support board 20 is rotated into its up or operational position. Once this step is completed, shelf support board 20 is held in the up position while each of the truss shelf supports is rotated so their faces are oriented orthogonal to the plane occupied by the two support legs. Once in their operational position, shelf support board 20 to be released and allowed to register against the top surfaces of truss shelf supports 24 and 26 as shown in FIG. 3*b*. To place the shelf support board and truss shelf supports in storage positions as shown in FIG. 3*a*, the described process is reversed. Shelf support board 20 is held in an up position while the two truss shelf supports are rotated inwardly to align with the support legs. The shelf support board is then rotated to its storage position, which overlaps the truss shelf supports and maintains them in their storage positions.

Shelf 50 in its simplest form, is an elongate board with a series of cutouts to create features that interlock with the slot feature of shelf support board 20. A top edge of shelf 50 is formed with a rabbit cut to create a shoulder dimensioned to fit within the cove formed by upper slot shoulder 27 and overhang 25. A top shelf board edge 56 has a section removed to form shelf shoulder 54 and shelf shoulder base 52. The dimensions of shelf shoulder 54 and shelf shoulder base 52 are set to enable shelf shoulder 54 to slide into the cove in shelf support board 20 to create an interference fit and a friction fit if the dimensional tolerances are set to enable substantial or full registration of the complementary surfaces.

To enable shelf 50 so sit within shelf-support slot 23, a large dado cut is made to a bottom or back surface 51 of shelf 50, from a shelf bottom shoulder 58 to a leading edge of shelf 50 to form a shelf cantilever support surface 53 that registers against shelf support board bottom end 29. Shelf bottom shoulder 58 is set to form a gap 60 further defined by lower slot shoulder 31, shelf cantilever support surface 53 and shelf-support slot 23. With top shelf board edge 56 inserted into the cove of shelf support board 20, back surface 51 registers against shelf-support slot 23 and shelf cantilever support surface 53 registers against shelf support board bottom end 29 to create a cantilever effect to support shelf 50 in a substantially horizontal orientation. To releasably lock shelf 50 to shelf support board 20, a locking shaft 64 is inserted into gap 60 to create a further interference/friction fit as shown in FIGS. 13, 17 and 18.

Figure 17:
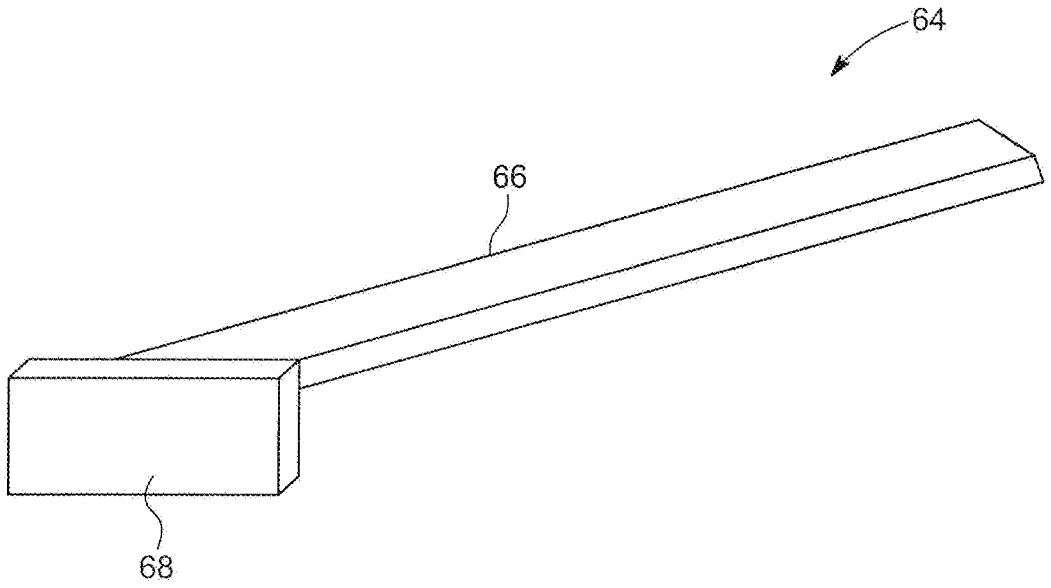
FIG. 17 is a top, side perspective view of a locking rail or locking shaft according to one embodiment of the disclosure.
Figure 18:
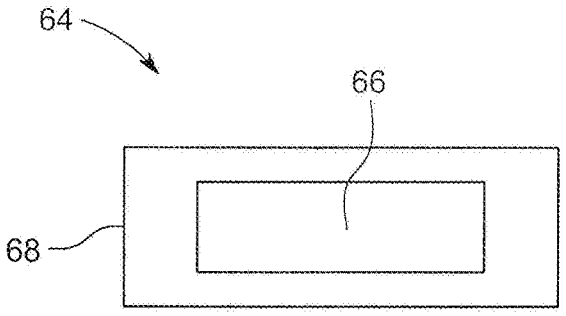
FIG. 18 is a back, end view of the locking rail or locking shaft shown in FIG. 17.

As shown particularly in FIGS. 17 and 18, locking shaft 64 has two basic components, an elongate shaft 66 and a finger or hand grip 68. Shaft 66 is dimensioned to extend at least a substantial portion of the length of shelf-support slot 23. The cross-sectional dimensions of shaft 66 are set to create a mechanical interference fit and friction fit with the surfaces of shelf support board 20 and shelf 50 against which shaft 66 registers. Finger grip 68 can conform to any regular or irregular geometric shape and/or be formed with surface features such as coves, to improve finger grasp. A recess configured in the overall shape of finger grip 68 may be formed on an end of the joined shelf support board 20 and shelf 50 to at least partially countersink finger grip 68 for aesthetic purposes.

Figure 12:
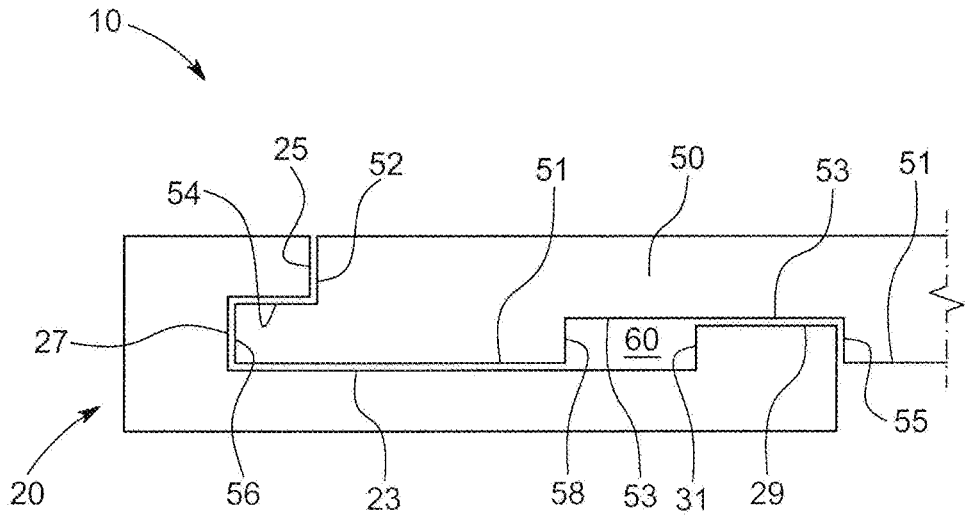
FIG. 12 is an end view of a shelf support board/shelf subassembly according to a further embodiment of the disclosure.
Figure 13:
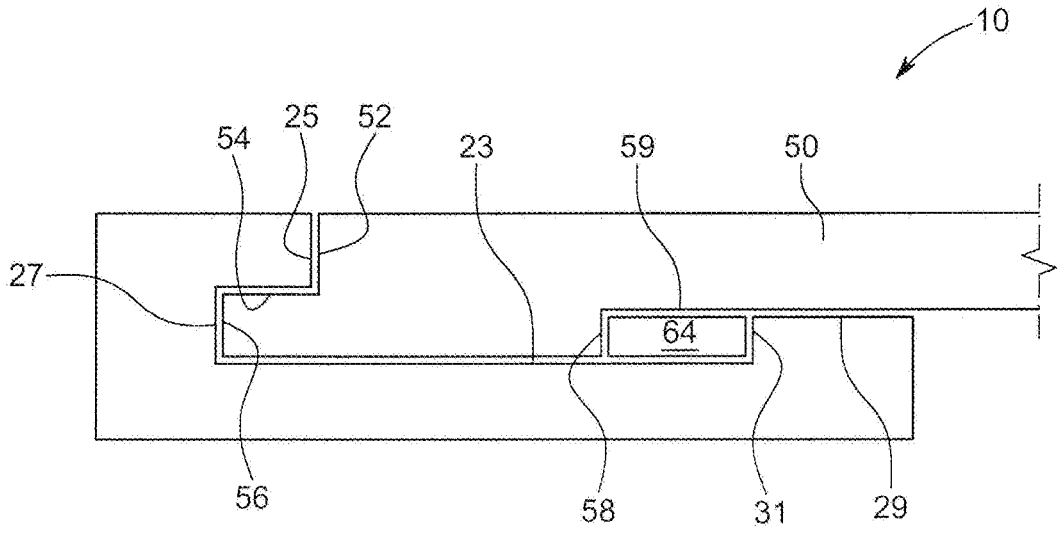
FIG. 13 is an end view of the shelf support board/shelf subassembly shown in FIG. 8 with a locking rail or locking shaft.
Figure 43:
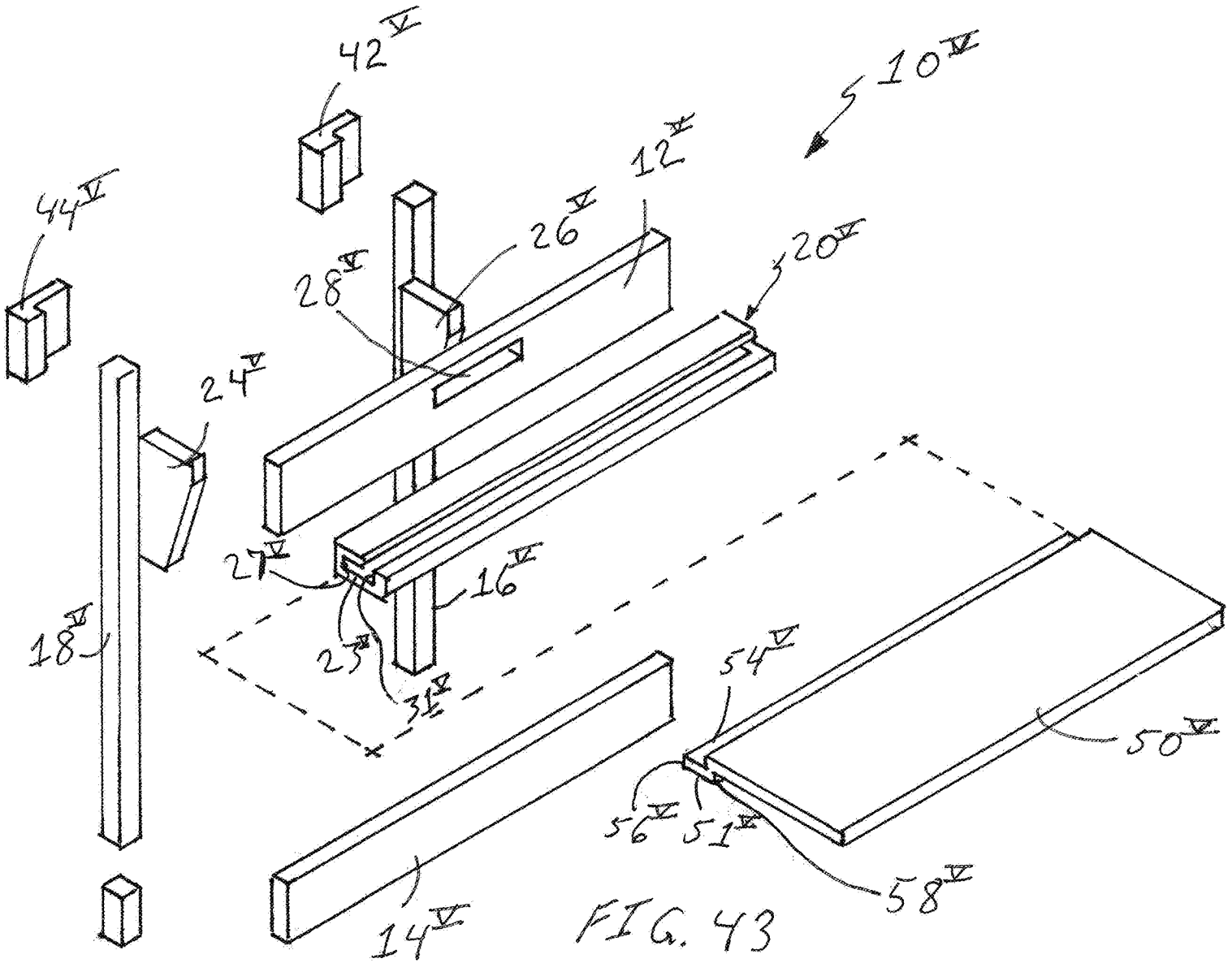
FIG. 43 is a top, side exploded view of an adjustable deck shelf assembly with a shelf having a reduced-dimension slot attachment means according to a further embodiment of the disclosure.
Figure 44:
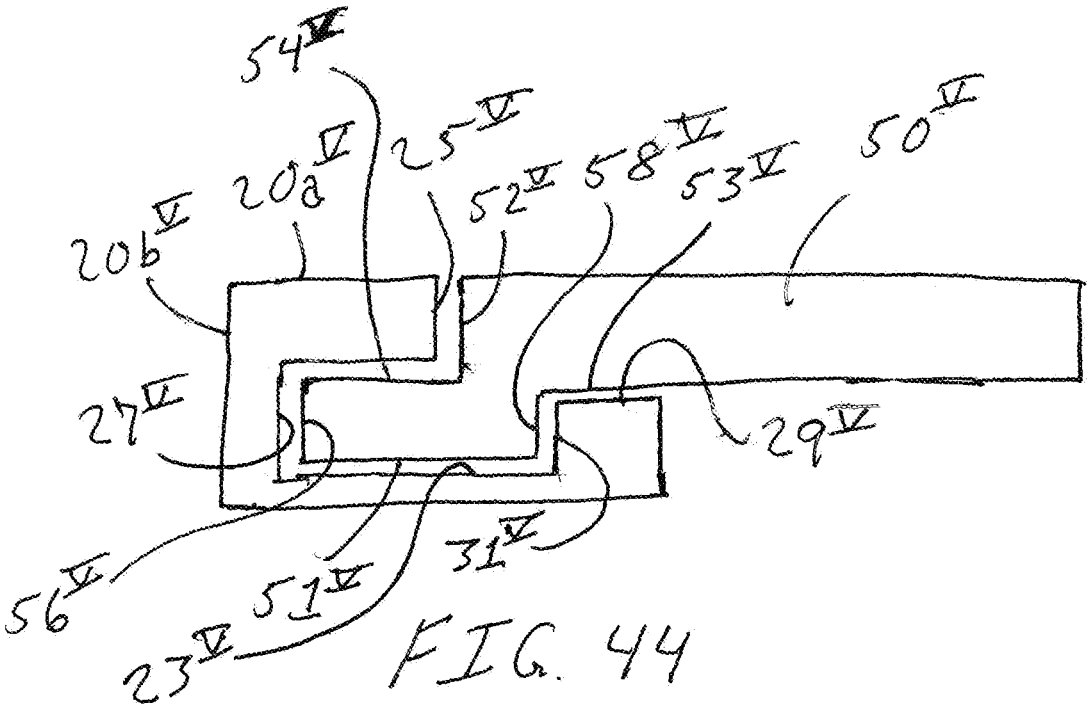
FIG. 44 is a side view of the shelf shown in FIG. 43 secured to the shelf support board.
Figure 45:
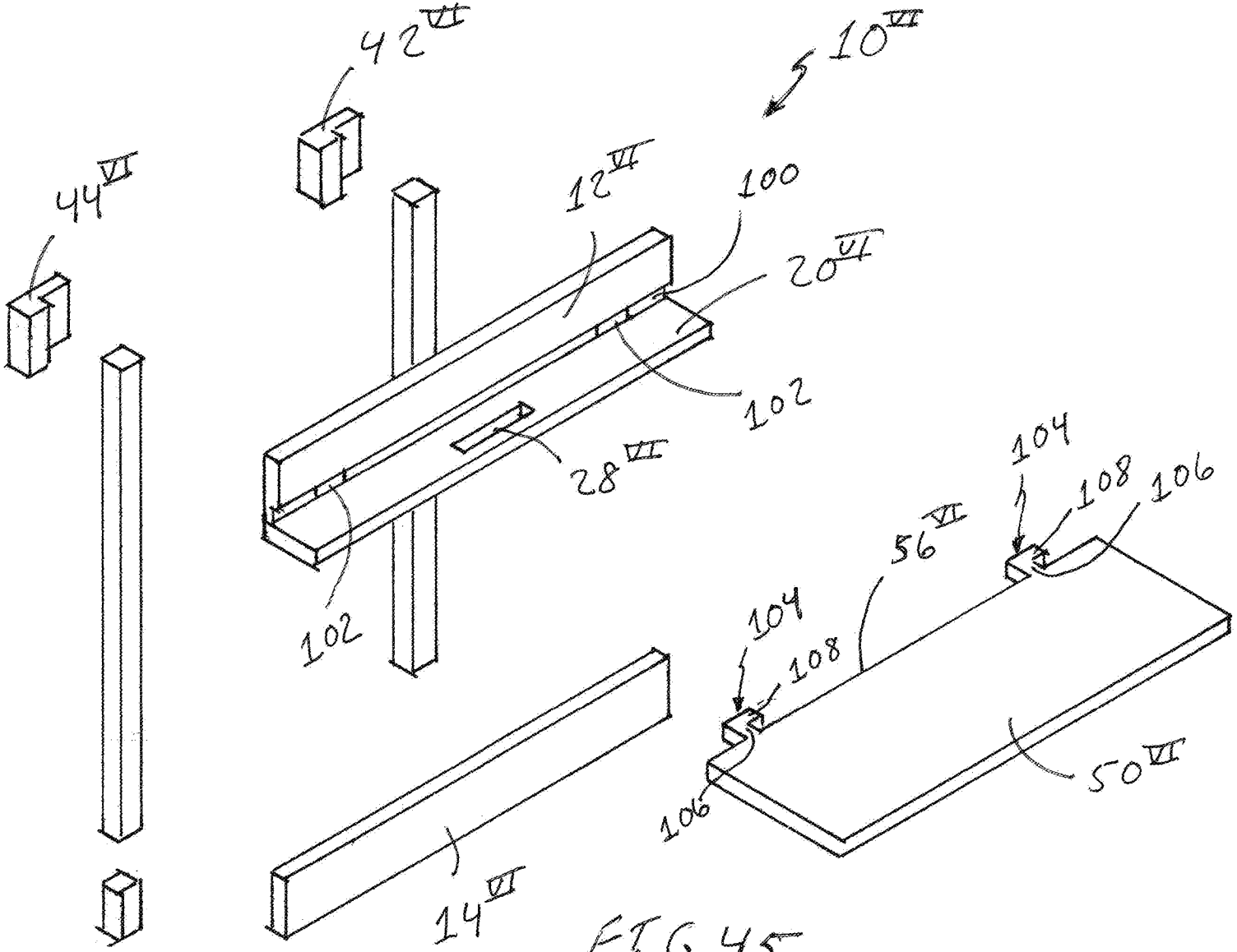
FIG. 45 is an exploded view of an adjustable deck shelf assembly with a hook-and-slot secured shelf according to a yet further embodiment of the disclosure.

Referring now to FIGS. 43 and 44, in an alternate embodiment, the deck shelf assembly 10 shown in FIGS. 12 and 13 is modified to eliminate the need for locking shaft 64. In a deck shelf assembly, designated generally as $\mathbf{10}^V$, a horizontal upper support board $\mathbf{12}^V$ is secured proximal to top ends of a first support leg $\mathbf{16}^V$ and a second support leg $\mathbf{18}^V$ in the same manner described with respect to the same components in deck shelf assembly 10. Like deck shelf assembly 10, horizontal upper support board $\mathbf{12}^V$ may include a hand-grip bore $\mathbf{28}^V$.

To secure the top end of the deck shelf assembly $\mathbf{10}^V$ to a deck rail, a pair of locking blocks are secured to the support legs. Secured to the top, back side of first support leg $\mathbf{16}^V$ is a first upper locking block $\mathbf{44}^V$. First upper locking block $\mathbf{44}^V$ is dimensioned to be wider than first support leg $\mathbf{16}^V$ to create a hook-like feature with the portion of the locking block that extends beyond the side of the support leg. The combination of the first support leg side and the extended portion of the locking block creates a slot for receiving a deck rail baluster. The means used to secure first upper locking block $\mathbf{44}^V$ to first support leg $\mathbf{16}^V$ includes the same bore and mechanical fastener combinations disclosed herein to secure first locking block 44 to first support leg 16.

Secured to the top, back side of second support leg $\mathbf{18}^V$ is a second upper locking block $\mathbf{42}^V$. Second upper locking block $\mathbf{42}^V$ is dimensioned to be wider than second support leg $\mathbf{18}^V$ to create a second slot with the portion of the locking block that extends beyond the side of the second support leg. The combination of the second support leg side and the extended portion of the second locking block creates a second slot for receiving a second deck rail baluster. The means used to secure second upper locking block $\mathbf{42}^V$ to second support leg $\mathbf{18}^V$ includes the same bore and mechanical fastener combinations disclosed herein to secure second locking block 42 to second support leg 18. It should be understood that any connection described herein as being made with mechanical fastener combinations can be made alternatively with adhesives and/or with interlocking components and remain within the scope of the disclosure.

To secure the bottom ends of the first and second support legs, a lower support board $\mathbf{14}^V$ is formed with a series of through-bore sets to enable support board $\mathbf{14}^V$ to be secured to the support legs via mechanical fasteners such as those used to secure lower support board 14 to first and second support legs, 16 and 18, The means used to secure lower support board $\mathbf{14}^V$ to first support leg $\mathbf{16}^V$ and second support leg $\mathbf{16}^V$ further includes the same bore and mechanical fastener combinations disclosed herein to secure lower support board 14 to first support leg 16 and second support leg 18 disclosed herein. It should be further understood that any variations described for lower support board 14 apply equally to lower support board $\mathbf{14}^V$.

A shelf support board, designated generally as $\mathbf{20}^V$, includes a modified lower slot shoulder $\mathbf{31}^V$ to create a modified mechanical lock between the support board and shelf. As shown, shelf support board $\mathbf{20}^V$ includes most of the same general features as shelf support board 20 including a shelf-support slot $\mathbf{23}^V$ formed in its front face. Unlike shelf support slot 23, shelf-support slot $\mathbf{23}^V$ must extend substantially the entire width of shelf support board $\mathbf{20}^V$ as the connection means for this embodiment is substantially like a sliding dovetail joint. In this embodiment, a front face $\mathbf{20}a^V$ of shelf support board $\mathbf{20}^V$ is the surface of the board that faces upwardly when assembled to shelf $\mathbf{50}^V$. A back edge $\mathbf{20}b^V$ of shelf support board 20' is the surface that faces the support legs when the shelf support board is in its operational position. Like shelf support board 20', the positioning shelf support board $\mathbf{20}^V$ in an up or down position is accomplished by rotating the shelf support board about the hinge pins.

As shown particularly in FIG. 44, the width or height (depending upon the support shelf's orientation) of shelf-support slot $\mathbf{23}^V$ is defined by an upper slot shoulder $\mathbf{27}^V$ and a lower slot shoulder $\mathbf{31}^V$. The angle defined by lower slot shoulder $\mathbf{31}^V$ and shelf-support slot $\mathbf{23}^V$ substantially may be a 90° or may be an acute angle cove in cross section. The advantageous nature of this angular shoulder is disclosed in more detail herein. An overhang $\mathbf{25}^V$ extends toward a center line of shelf support board $\mathbf{20}^V$ from a top edge of shelf support board $\mathbf{20}^V$ and forms an elongate cove in conjunction with upper slot shoulder $\mathbf{27}^V$. A shelf support board bottom end $\mathbf{29}^V$ of shelf support board $\mathbf{20}^V$ has a reduced thickness relative to the thickness of shelf support board 20" at the back edge $\mathbf{20}b^V$ of the board. As disclosed in more detail herein, shelf support board bottom end $29^V$ functions as a cantilever support surface for a shelf $50^V$ or any variation disclosed herein.

To accommodate the modified lower shoulder feature of shelf support $20^V$, shelf $50^V$, like shelf 50, is an elongate board with a series of cutouts to create features that interlock with the modified slot feature of shelf support board $20^V$. A top edge of shelf $50^V$ is formed with a rabbit cut to create a shoulder dimensioned to fit within the cove formed by upper slot shoulder $27^V$ and overhang $25^V$. A top shelf board edge $56^V$ has a section removed to form shelf shoulder $54^V$ and shelf shoulder base $52^V$. The dimensions of shelf shoulder $54^V$ and shelf shoulder base $52^V$ are set to enable shelf shoulder $54^V$ to slide laterally into the cove in shelf support board $20^V$ to create a mechanical interference fit and a friction fit if the dimensional tolerances are set to enable substantial or full registration of the complementary surfaces. The dimensional tolerances are set to ensure the shelf cannot be disengaged from the shelf support board other than through lateral movement of the shelf relative to the shelf support board. Lateral stops (not shown) may be incorporated to lock the shelf's lateral orientation to the shelf support board.

To enable shelf $50^V$ to sit within shelf-support slot $23^V$, a large section is removed from a bottom or back surface $51^V$ of shelf $50^V$ and formed with a shelf bottom shoulder $58^V$ that extends to a leading edge of shelf $50^V$ to form a shelf cantilever support surface $53^V$ that registers against shelf support board bottom end $29^V$. The distance between shelf bottom shoulder $58^V$ and upper slot shoulder $27^V$ is set to ensure tight dimensional tolerances between the shelf board support and the shelf on the order of about $\frac{1}{8}^V$ to ensure a tight, secure fit.

Figure 11:
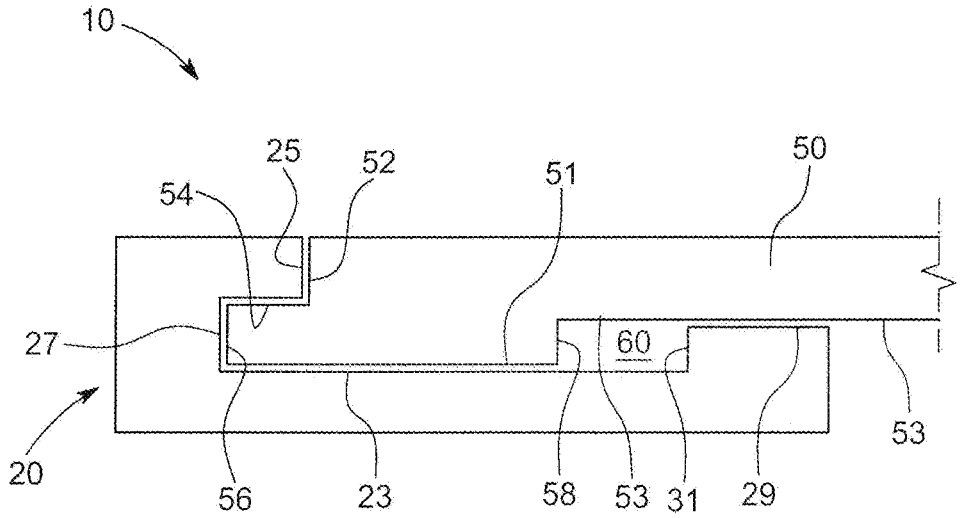
FIG. 11 is an end view of the shelf support board/shelf subassembly shown in FIG. 8 without a locking rail or locking shaft.

Compared to the comparable elements of the embodiments shown in FIGS. 10-17, the length of cantilever support surface $53^V$ is shortened to substantially reduce the width of gap 60 (shown in FIG. 11). In doing so, the distance between shelf bottom shoulder $58^V$ and lower slot shoulder $31^V$ is reduced. Illustratively, a small gap on the order from about ⅛ inch to about ¼ inch is maintained to enable shelf $50^V$ to be inserted laterally into and fit within the cove formed by upper slot shoulder $27^V$ and overhang $25^V$ with back surface $51^V$ registering against shelf-support slot $23^V$. The small gap may be set to be outside the illustrative, non-limiting parameters set forth herein. It further should be understood that other embodiments of the shelf bottom shoulder $58^V$ disclosed herein may be substituted for shelf bottom shoulder $58^V$. With top shelf board edge $56^V$ inserted laterally into the cove of shelf support board $20^V$, back surface $51^V$ registers against shelf-support slot $23^V$ and shelf cantilever support surface $53^V$ registers against shelf support board bottom end $29^V$ to create a cantilever effect to support shelf $50^V$ in a substantially horizontal orientation.

Referring now to FIG. 44, in another embodiment of the disclosure, a deck shelf assembly, designated generally as $10^{VI}$, uses a hook and slot engagement means to secure a shelf to a shelf support board. Deck shelf assembly $10^{VI}$ includes a horizontal upper support board $12^{VI}$ is secured proximal to top ends of a first support leg $16^{VI}$ and a second support leg $18^{VI}$ in the same manner described with respect to the same components in deck shelf assembly 10.

To secure the top end of the deck shelf assembly $10^{VI}$ to a deck rail, a pair of locking blocks are secured to the support legs. Secured to the top, back side of first support leg $16^{VI}$ is a first upper locking block $40^{VI}$. First upper locking block $44^{VI}$ is dimensioned to be wider than first support leg $16^{VI}$ to create a hook-like feature with the portion of the locking block that extends beyond the side of the support leg. The combination of the first support leg side and the extended portion of the locking block creates a slot for receiving a deck rail baluster. The means used to secure first upper locking block $44^{VI}$ to first support leg $16^{VI}$ includes the same bore and mechanical fastener combinations disclosed herein to secure first locking block 44 to first support leg 16.

Secured to the top, back side of second support leg leis a second upper locking block $42^{VI}$. Second upper locking block $42^{VI}$ is dimensioned to be wider than second support leg $18^{VI}$ to create a second slot with the portion of the locking block that extends beyond the side of the second support leg. The combination of the second support leg side and the extended portion of the second locking block creates a second slot for receiving a second deck rail baluster. The means used to secure second upper locking block $42^{VI}$ to second support leg $18^{VI}$ includes the same bore and mechanical fastener combinations disclosed herein to secure second locking block 42 to second support leg 18.

To secure the bottom ends of the first and second support legs, a lower support board $14^{VI}$ is formed with a series of through-bore sets to enable support board $14^{VI}$ to be secured to the support legs via mechanical fasteners such as those used to secure lower support board 14 to first and second support legs, 16 and 18, The means used to secure lower support board $14^{VI}$ to first support leg $16^{VI}$ and second support leg $16^{VI}$ further includes the same bore and mechanical fastener combinations disclosed herein to secure lower support board 14 to first support leg 16 and second support leg 18 disclosed herein. It should be further understood that any variations described for lower support board 14 apply equally to lower support board $14^{VI}$.

A shelf support board, designated generally as $20^{VI}$, is secured to a lower edge of upper support board $12^{VI}$ to form an "L" shape in side profile. Optionally, a front portion of a bottom end of upper support board $12^{VI}$ is removed to form a lateral slot 100. Lateral slot 100 is dimensioned to receive a top shelf board edge $56^{VI}$ of a shelf $50^{VI}$. It should be understood that lateral slot 100 can be eliminated in this embodiment to cut down on manufacturing costs without compromising the functional integrity of the embodiment.

Formed proximal the lateral edges of upper support board $12^{VI}$ are hook-engaging slots 102. The spacing of the slots can be varied to accommodate any particular application. At least two slots should be used to positively secure the shelf to the shelf support board. Like deck shelf assembly 10, a hand-grip bore $28^{VI}$ may be incorporated into the embodiment and in this embodiment, formed in shelf support board $20^{VI}$.

Shelf $50^{VI}$ has shelf hooks, designated generally as 104, extending backwardly from the back edge $56^{VI}$. Shelf hooks 104 are each dimensioned to fit within, spaced to align with, and numbered to match the number of, slots 102. Each Shelf hook 104 includes a hook base 106 and a hook leg 108 extending laterally from a distal end of hook base 106. It should be understood that hook legs 108 can extend toward either edge of the shelf as long as both, or all if more than two are used, extend in the same direction. The width of slots 102 are dimensioned to be slightly longer than the length of hook legs 108. To secure shelf $50^{VI}$ to shelf support board $20^{VI}$, hook legs 108 are inserted into hook-engaging slots 102 until back edge $56^{VI}$ registers against upper support board $12^{VI}$ or a back of lateral slot 100 (if present). Shelf $50^{VI}$ is then shifted laterally until hook bases 106 register against ends of hook-engaging slots 102. It should be understood the orientation of the hook-engaging slots 102 and shelf hooks 104 relative to the lateral edges of shelf $50^{VI}$ are set so that the lateral edges of shelf 50$^{VI}$ align with the lateral edges of shelf support board 20$^{VI}$ when the shelf is fully engaged with and locked to the shelf support board. Once the hooks and slots are engaged, shelf 50$^{VI}$ is registered against, and supported by, a top surface of shelf support board 20$^{VI}$. It should be understood that the hook and slot shelf engagement means described can be applied to the adjustable deck shelf/deck seat assembly 10$^{VI}$ shown in FIGS. 21 and 22 by forming the hook-engaging slots in the secondary upper support board 13 to receive the hooks on the back end of shelf 50.

Figure 14:
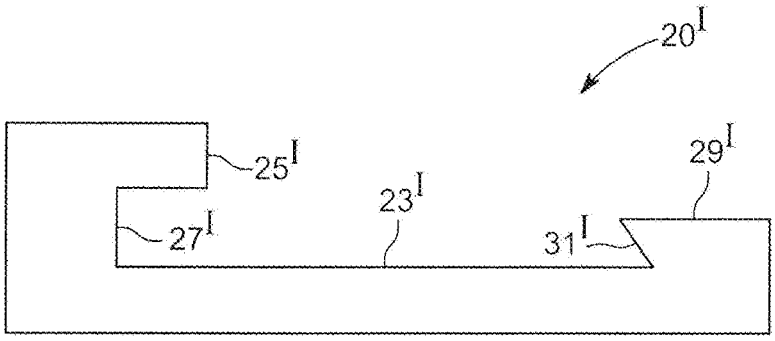
FIG. 14 is an end view of a shelf support according to a yet further embodiment of the disclosure.
Figure 15:
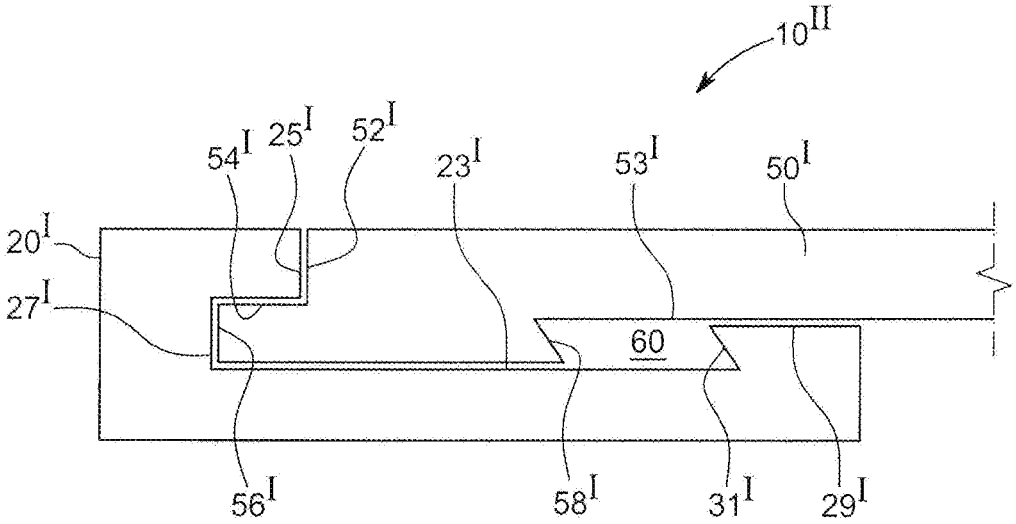
FIG. 15 is an end view of the shelf support board shown in FIG. 14 with a shelf assembled to the shelf support board according to the embodiment of the disclosure shown in FIG. 14.
Figure 16:
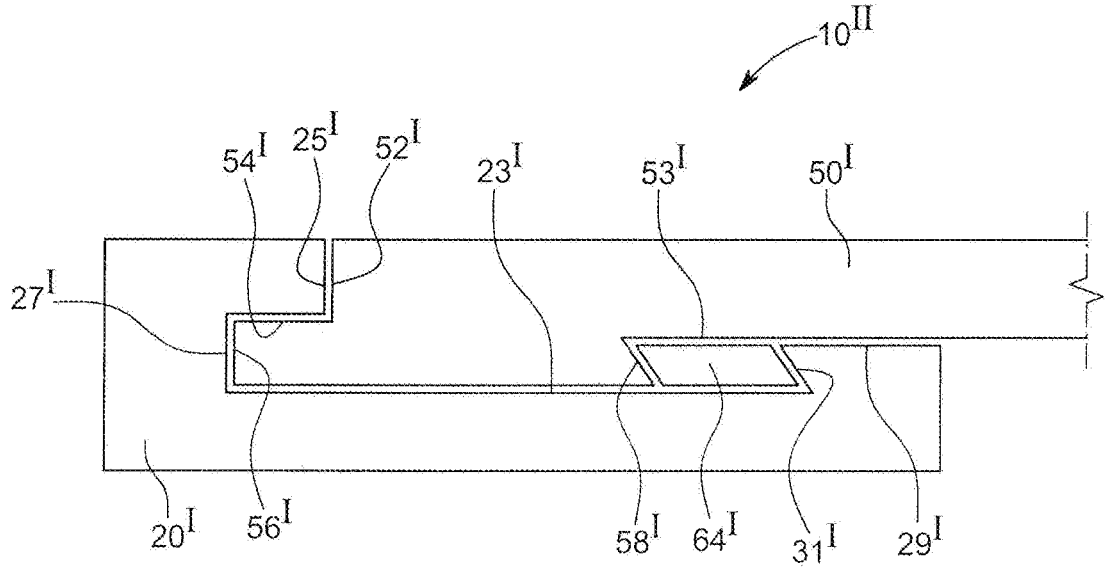
FIG. 16 is an end view of the shelf support board/shelf subassembly embodiment shown in FIG. 15 with a locking rail.

Referring now to FIGS. 14-16, in a yet further alternative embodiment, a shelf support board, designated generally as 20', includes a modified lower slot shoulder 31' to create a modified mechanical lock between the support board, shelf and locking shaft. As shown, shelf support board 20' includes most of the same general features as shelf support board 20 including a shelf-support slot 23' formed in its front face. Like shelf support slot 23, shelf-support slot 23' may extend the entire width of shelf support board 20' or may extend over only a partial segment of shelf support board 20'. Again, for the purpose of clarity, the front face 20*a*' of shelf support board 20' is the surface of the board that faces out from a front side of the overall assembly 10 when the shelf support board is in a down or storage position. A top edge 20*b*' of shelf support board 20' is the surface that faces the hinge blocks 22 when the shelf support board is in a storage position. When the shelf support board is in an up or operational position, front face 20*a*' is now a top surface of the shelf support board. Positioning shelf support board 20' in an up or down position is accomplished by rotating the shelf support board about the hinge pins.

As shown particularly in FIG. 14, the width or height (depending upon the support shelf's orientation) of shelf-support slot 23' is defined by an upper slot shoulder 27' and an angular, lower slot shoulder 31'. The angle of lower slot shoulder 31' is oriented to form an acute angle cove in cross section. The advantageous nature of this angular shoulder is disclosed in more detail herein. An overhang 25' extends toward a center line of shelf support board 20' from a top edge of shelf support board 20' and forms an elongate cove in conjunction with upper slot shoulder 27'. A shelf support board bottom end 29' of shelf support board 20' has a reduced thickness relative to the thickness of shelf support board 20' at the top end 20*b*' of the board. As disclosed in more detail herein, shelf support board bottom end 29' functions as a cantilever support surface for a shelf 50 or any variation disclosed herein.

To accommodate the modified lower shoulder feature of shelf support 20', a modified shelf 50' is provided. Shelf 50', like shelf 50, is an elongate board with a series of cutouts to create features that interlock with the modified slot feature of shelf support board 20'. A top edge of shelf 50' is formed with a rabbit cut to create a shoulder dimensioned to fit within the cove formed by upper slot shoulder 27' and overhang 25'. A top shelf board edge 56' has a section removed to form shelf shoulder 54' and shelf shoulder base 52'. The dimensions of shelf shoulder 54' and shelf shoulder base 52' are set to enable shelf shoulder 54' to slide into the cove in shelf support board 20' to create a mechanical interference fit and a friction fit if the dimensional tolerances are set to enable substantial or full registration of the complementary surfaces.

To enable shelf 50' to sit within shelf-support slot 23', a large section is removed from a bottom or back surface 51' of shelf 50' and formed with an angular (half dovetail) shelf bottom shoulder 58' that extends to a leading edge of shelf 50' to form a shelf cantilever support surface 53' that registers against shelf support board bottom end 29'. Angular shelf bottom shoulder 58' is set to form a gap 60' further defined by angular lower slot shoulder 31', shelf cantilever support surface 53' and shelf-support slot 23'. The direction of the angles of angular shelf bottom shoulder 58' and angular lower slot shoulder 31' are set to be substantially parallel to create a trapezoid-shaped gap 60'. The application of angular shoulders provides an advantageous additional structural restriction that prevents shelf 50' from lifting off shelf support board 20 when secured with a locking shaft. With top shelf board edge 56' inserted into the cove of shelf support board 20', back surface 51' registers against shelf-support slot 23' and shelf cantilever support surface 53' registers against shelf support board bottom end 29' to create a cantilever effect to support shelf 50' in a substantially horizontal orientation.

To releasably lock shelf 50' to shelf support board 20', a locking shaft 64' (shown in FIGS. 16, 19 and 20) having a substantially trapezoid shape in cross section is inserted into gap 60' to create a further interference/friction fit as shown in FIG. 16. It should be understood that the geometric shape formed by the angular shelf bottom shoulder 58' and angular lower slot shoulder 31' can be modified by changing the angles of the shoulders to form other geometric shapes in cross section including a corresponding change in shape of the corresponding locking shaft and remain within the scope of the disclosure.

Figure 19:
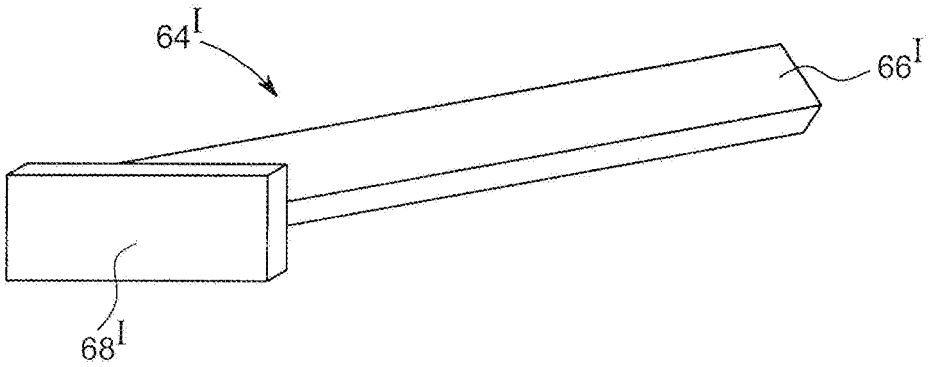
FIG. 19 is a top, side perspective view of a locking rail or locking shaft according to another embodiment of the disclosure.
Figure 20:
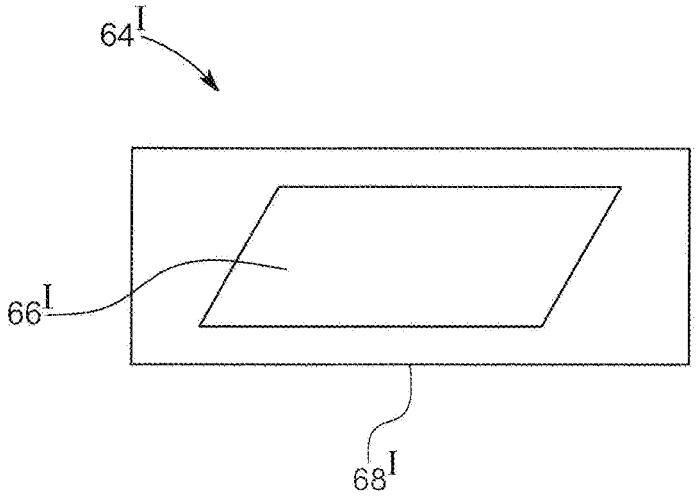
FIG. 20 is a back-end view of the locking rail or locking shaft shown in FIG. 19.

As shown particularly in FIGS. 19 and 20, locking shaft 64' has two basic components, an elongate shaft 66' and a finger grip 68'. Shaft 66' has a trapezoid shape in cross section and is dimensioned to extend at least a substantial portion of the length of shelf-support slot 23'. The cross-sectional dimensions of shaft 66' are set to create a mechanical and friction fit with the surfaces of shelf support board 20' and shelf against which shaft 66' registers. Finger grip 68' can conform to any regular or irregular geometric shape and/or be formed with surface features such as coves, to improve finger grasp. Like locking shaft 64, a recess configured in the overall shape of finger grip 68' may be formed on an end of the joined shelf support board 20' and shelf to at least partially countersink finger grip 68' for aesthetic purposes.

Both shelf 50 and shelf 50' can be modified to maintain the overall thickness of the shelves by using a reduced-dimension cut to receive shelf support board bottom end 29 or 29'. The same modification to shelf 50 shown in FIG. 12 can be applied to shelf 50'. A second shelf bottom shoulder 55 is formed when creating a smaller-dimension cut. In this embodiment, the cantilevered section extending beyond bottom end 29 or 29' can have a larger thickness for aesthetic and structural integrity purposes. In a yet further alternative embodiment, the various slots and shoulders of shelf 50 or 50' can be created by laminating boards together to create the cutout features in a method well known in the art.

Figure 26:
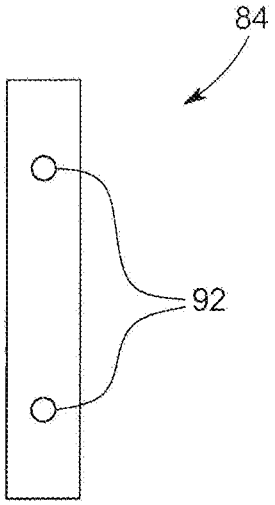
FIG. 26 is a side view in elevation of the adjustable shelf/seat support outrigger shown in FIG. 23.
Figure 27:
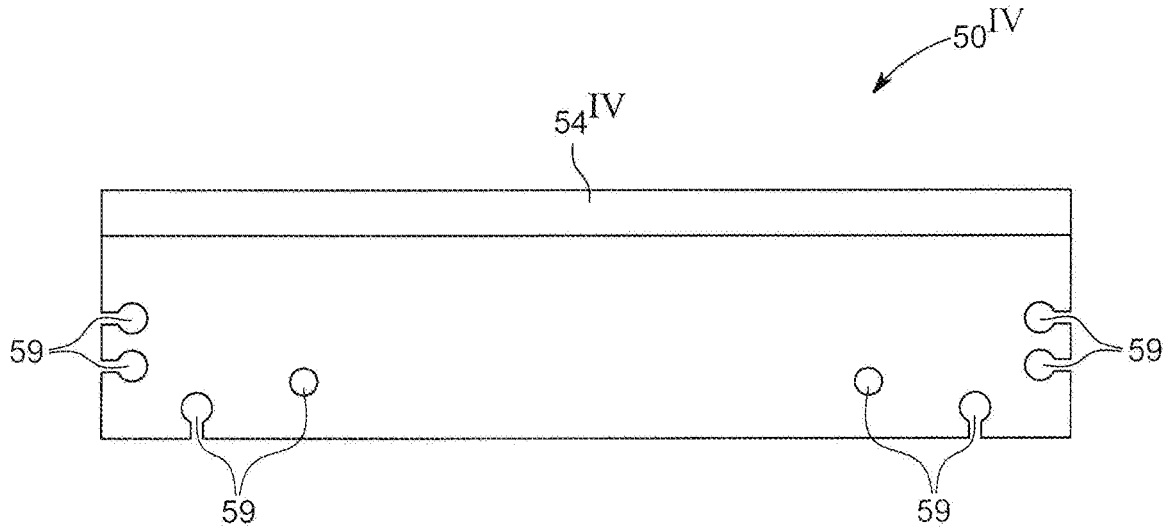
FIG. 27 is a top view of a utensil-holding shelf according to another embodiment of the disclosure.
Figure 28:
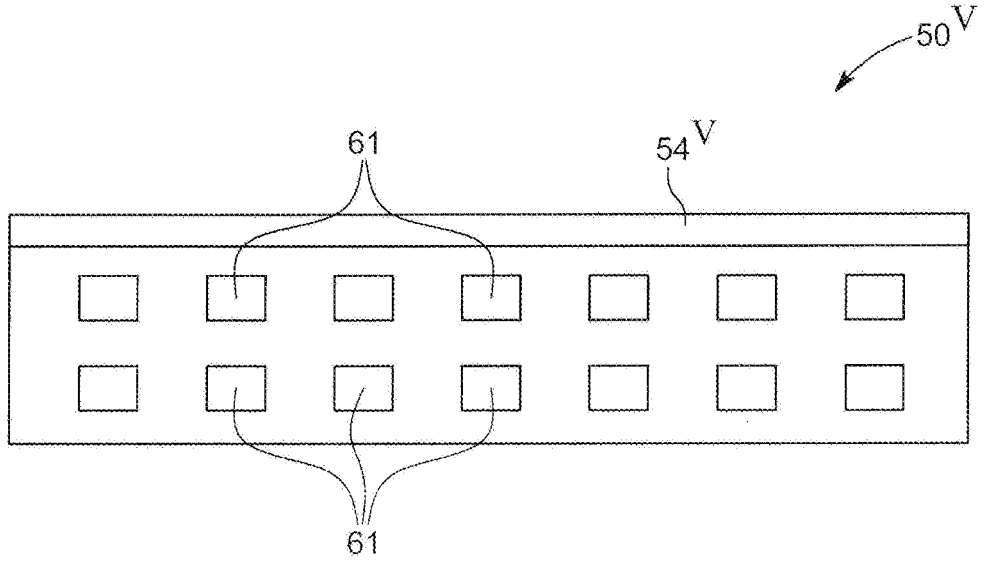
FIG. 28 is a top view of a shelf formed as a drying rack according to a further embodiment of the disclosure.
Figure 30:
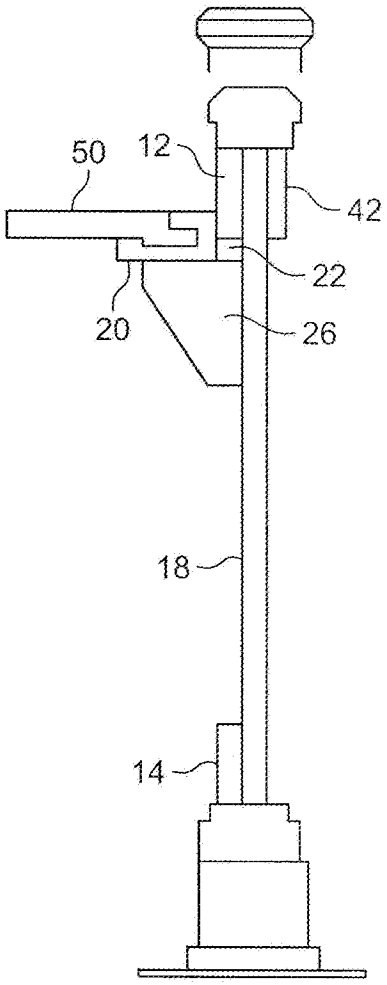
FIG. 30 is a side view in elevation of the adjustable deck shelf assembly secured to a deck railing shown in FIG. 29 with the shelf-support board/shelf subassembly in the up or operational position.

Both shelf 50 and shelf 50' can be structured with additional features, such as the utensil holding features of shelf 50$^{VI}$ shown in FIG. 26. In this shelf embodiment, one or more utensil holding slots or through-bores 59 are formed along the edges or in the field of the shelf. The dimensions of the slots or through-bores can be adjusted to accommodate differently sized utensils. Hooks (not shown) also may be secured to the shelf to hang items such as utensils and towels. Shelves 50 and 50' also can be structured with the features of drying rack shelf 50$^{V}$ as shown in FIG. 27. A series of holes or slots 61 result in the shelf taking on the shape of a lattice to facilitate the drying of wet towels or like items placed on drying rack shelf 50$^{VI}$. It should be understood that shelves 50 and 50' can be modified to address other specific desired functionalities, e.g., card game table and remain within the scope of the disclosure. The features shared in common with any of the shelf embodiments will be the shelf registration surfaces that register against the registration surfaces of the shelf support boards.

II. Deck Shelf/Seat Assembly

Referring now to FIGS. 21-25, in another aspect of the disclosure, a combination deck shelf/seat assembly, designated generally as 10", includes features that enable the assembly to be used as a shelf system or as a seat system. Deck shelf/seat assembly 10" includes a horizontal upper support board 12". For this embodiment, upper support board 12" may be fixed relative to support legs disclosed on more detail herein. Upper support board 12" is formed with a pair of vertically-oriented first-leg through-bores 15" (not shown) located proximal a first or left end of upper support board 12" and dimensioned to receive mechanical fasteners. A first support leg 16" is formed with a pair of vertically-oriented, first support leg upper through-bores 17" (not shown) proximal a top end of the support leg, dimensioned and spaced to align with through-bores 15" of upper support board 12". A pair of mechanical fasteners 40", e.g., lag bolt and/or bolt/nut/washer combinations (described for deck shelf 10 and applicable to this embodiment) are each inserted into each pair of aligned through-bores 15" and 17" in upper support board 12" and support leg 16", respectively, and secured with nuts 46" (not shown) to secure the top end of first support leg 16" to upper support board 12". Once attached, the orientation of first support leg 16" to upper support board 12" is substantially orthogonal. Other alignment orientations are possible and remain within the scope of the disclosure as disclosed in more detail herein.

Formed on a right side of upper support board 12" is a plurality of second-leg through-bores 34". Through-bores 34" are substantially equally spaced and arranged in a pair of substantially parallel through-bore lines. At least one pair of vertically-aligned through-bores 34" is needed. The arrangement permits a second support leg 18" to be secured to upper support board 12" with mechanical fasteners 40". A pair of corresponding second support leg upper through-bores 19" (not shown) are formed proximal a top end of second support leg 18" and spaced vertically to align with the spacing of the parallel lines of through-bores 34". To set the horizontal distance between first support leg 16" and second support leg 18", a column of second-leg through-bores 34" is selected and aligned with second support leg upper through-bores 19" and secured with mechanical fasteners 40". In similar fashion to deck shelf assembly 10', the spacing of the columns of second-leg through-bores 34" set the defined horizontal distances possible between the two support legs. It should be understood that the number of columns of second-leg through-bores 34" can be varied and remain within the scope of the disclosure.

Upper support board 12" may be formed with an optional hand-grip bore 28". Hand-grip bore 28", if provided, may be shaped to conform to a closed hand with radiused edges to provide a comfortable grip for lifting and manipulating deck shelf/seat assembly 10". Alternatively, two spaced hand-grip bores (not shown) may be incorporated into upper support board 12" to facilitate two-hand manipulation of the assembly. The overall shape and dimensions of hand-grip bore 28" may be altered for alternative functions, such as a hanging slot and remain within the scope of the disclosure.

To secure the top end of the deck shelf/seat assembly 10" to a deck rail, a pair of locking blocks are secured to the support legs. Secured to the top, back side of first support leg 16" is a first upper locking block 44" (not shown). First upper locking block 44" is the same as first upper locking block 44 both structurally and functionally. First upper locking block 44" is dimensioned to be wider than first support leg 16" to create a hook-like feature with the portion of the locking block that extends beyond the side of the support leg. The combination of the first support leg side and the extended portion of the locking block creates a slot for receiving a deck rail baluster. A pair of vertically-aligned first locking block through-bores 45" are dimensioned and spaced to align with first-leg through-bores 15" and first support leg upper through-bores 17". The same mechanical fasteners 40" used to secure upper support board 12" to first support leg 16" are used to secure first locking block 44" to the back side of upper support board 12".

Secured to the top, back side of second support leg 18" is a second upper locking block 42". Second upper locking block 42" is dimensioned to be wider than second support leg 18" to create a second slot with the portion of the locking block that extends beyond the side of the second support leg. The combination of the second support leg side and the extended portion of the second locking block creates a second slot for receiving a second deck rail baluster. A pair of vertically-aligned second locking block through-bores 43" are dimensioned and spaced to align with second-leg through-bores 34" and second support leg upper through-bores 19". The same mechanical fasteners 40" used to secure upper support board 12" to second support leg 18" are used to secure second locking block 44" to the back side of upper support board 12".

In the analogous embodiment shown in FIG. 2, first locking block 44 (corresponding to first locking block 44" of the currently described embodiment), and second locking block 42 (corresponding to second locking block 42" of the currently described embodiment), create slots facing the same direction. This enables deck shelf/seat assembly 10" to be secured to a deck railing by aligning the locking blocks between balusters and shifting assembly 10" in the direction of the slots to engage balusters with the slots. This sets the relative horizontal alignment of deck shelf/seat assembly 10" to the deck railing. In the analogous embodiment shown in FIG. 7, the locking blocks are positioned so the slots formed by the locking blocks do not face the same direction but face each other. For this embodiment, one of the locking blocks has to be pivoted by removing one mechanical fastener so the locking block does not create a slot and hook a baluster while the other fixed locking block hooks a baluster via the side translational movement of assembly 10". Once assembly 10" has been aligned with the deck railing, the loosened locking block is pivoted back into position and secured with the mechanical fastener that was removed previously.

To secure the bottom ends of the first and second support legs, a lower support board 14" is formed with a series of through-bore sets to enable lower support board 14" to be secured to the support legs via mechanical fasteners 40". With respect to first support leg 16", a pair of vertically-oriented, lower support board first-leg through-bores 35" (not shown but similar to the lower support board first-leg through-bores 35 shown in FIG. 4) are formed proximal a left end of lower support board 14". One or more pairs of first support leg lower through-bores 30" are formed at a lower end of first support leg 16" and are spaced to align with the spacing of through-bores 35". If only one pair of second support leg lower through-bores 30" are used, the height of lower support board 14" will be oriented in a fixed position relative to upper support board 12". Likewise, the horizontal orientation of first support leg 16" to lower support board 14" will be fixed. If more than one pair of vertically-oriented lower support board first-leg through-bores 35" are included in a pair of substantially parallel rows, the horizontal orientation of first support leg 16" relative to lower support board 14" can be made variable. It should be understood that the vertical and horizontal orientation of first support leg 16" to the upper and lower support boards may be made variable by adding additional columns of substantially parallel first-leg through-bore sets in the upper and lower support boards.

With respect to second support leg 18", formed proximal a right side of lower support board 14" is a plurality of second-leg lower through-bores 36". Lower through-bores 36" are substantially equally spaced and arranged in a pair of vertically-oriented, substantially parallel through-bore rows. Each through-bore 36" of one row is vertically aligned with a through-bore 36" of the second row. This ensures orthogonal alignment of the support leg relative to the lower support board. At least one pair of vertically-aligned through-bores 36" is needed. The arrangement permits a lower end of second support leg 18" to be secured to lower support board 14" with mechanical fasteners 40". One or more pairs of corresponding, vertically-aligned, lower second support leg through-bores 32" are formed proximal a bottom end of second support leg 18" and spaced vertically to align with the spacing of the parallel lines of second-leg through-bores 34". Second support leg 18" may be formed with a single pair of vertically-aligned, second support leg through-bores 32" to create a fixed vertical orientation of the second support leg to lower support board 14". By including additional pairs of through-bores 32", the height of lower support board 14" relative to second support leg 18" and upper support board 12" can be adjusted to accommodate a specific railing height.

In similar fashion to deck shelf assembly 10, it should be understood that the orthogonal alignment of the support legs to the upper and lower support boards of deck shelf/seat assembly 10" can be modified to adapt the deck shelf/seat assembly to a particular deck railing configuration in which the balusters may be offset from a 90° alignment and remain within the scope of the disclosure. In such a configuration, the support legs can be oriented to the upper and lower support boards at an angle to match the angle of the railing balusters. This can be accomplished by realigning pairs of the vertically-oriented second-leg lower through-bores 36" to be offset at an angle that matches the angle of the subject balusters. In this configuration, the upper and lower support boards will remain in a substantially parallel and horizontal orientation regardless of the support leg angular orientations used to maintain alignment with the railing to which the assembly is secured. Similar adjustments can be made to the orientation of the through-bores, i.e., angled columns of through-bores to match the angular orientation of a stair railing.

To accommodate different spatial orientations of the bottom rails of railing systems, modifications can be made to the orientation of lower support board 14" relative to the support legs. The alternative embodiment of the lower support board embodiment shown in FIG. 5 for deck shelf assembly 10 can be applied to deck shelf/seat assembly 10" and lower support board 14". As shown in FIG. 5, lower support board 14' is offset from the lower ends of the support legs such as a second support leg 18'. The offset of support board 14' (or lower support board 14") is accomplished by biasing a plurality of second-leg lower through-bores (not shown), similar to second-leg lower through-bores 36", toward the upper edge of lower support board 14' (or lower support board 14").

When lower support board 14" is secured to second support leg 18" and a first support leg (not shown), a gap is formed on the back side of the lower support board with the upper end of the gap defined by the bottom end of the support legs, such as second-support leg 18' (or second-support leg 18"). This enables lower support board 14" to register directly against a lower rail of a railing system to provide a large surface area of support rather than register against the balusters of the rail system. As previously disclosed, this configuration is especially advantageous when the face of the lower railing of a railing system is aligned with the faces of the balusters to which the deck shelf/seat assembly 10" is secured. The support legs of assembly 10" will register against the sides of the balusters and lower support board 14" will register directly against the lower railing.

Deck shelf/seat assembly 10" can be further modified to accommodate lower deck railings, the sides of which are proud of the surfaces of the balusters. The modification shown in FIG. 6 for deck shelf assembly 10 can be applied to deck shelf/seat assembly 10". As shown in FIG. 6, spacer block **14*a* is used to further offset a lower support board such as lower support board 14" from the support legs of deck shelf/seat assembly 10". Lower support board 14'" (or lower support board 14") is offset from the lower ends of the support legs such as a second support leg 18'" (or second support leg 18") with spacer block 14*a*. The offset of support board 14" is again accomplished by biasing a plurality of second-leg lower through-bores (not shown), similar to second-leg lower through-bores 36, toward the upper edge of lower support board 14'" (or lower support board 14"**).

When lower support board 14'" (or lower support board 14") is secured to second support leg 18'" (or second support leg 18") with spacer block **14*a* sandwiched between the lower support board and each of the support legs, a relatively large gap is formed on the back side of the lower support board with the upper end of the gap defined by the bottom end of the support legs and the bottom edge of the spacer block. For purposes of this embodiment, one spacer block 14*a* can be used for each support leg or a single spacer block 14*a* can be used that extends the distance between the most distant edges of the support legs, such as second-support leg 18'" as shown (or second support leg 18"). Like the embodiment shown in FIG. 5, this enables lower support board 14" to register directly against a lower rail of a railing system to provide a large surface area of support rather than register against the balusters of the rail system. This configuration is especially advantageous when the face of the lower railing of a railing system is proud of, or extends outwardly from, the faces of the balusters to which the assembly 10" is secured. The support legs of assembly 10"** will register against the sides of the balusters and the lower support board will register directly against the face or outer edge of the lower railing.

Figure 21:
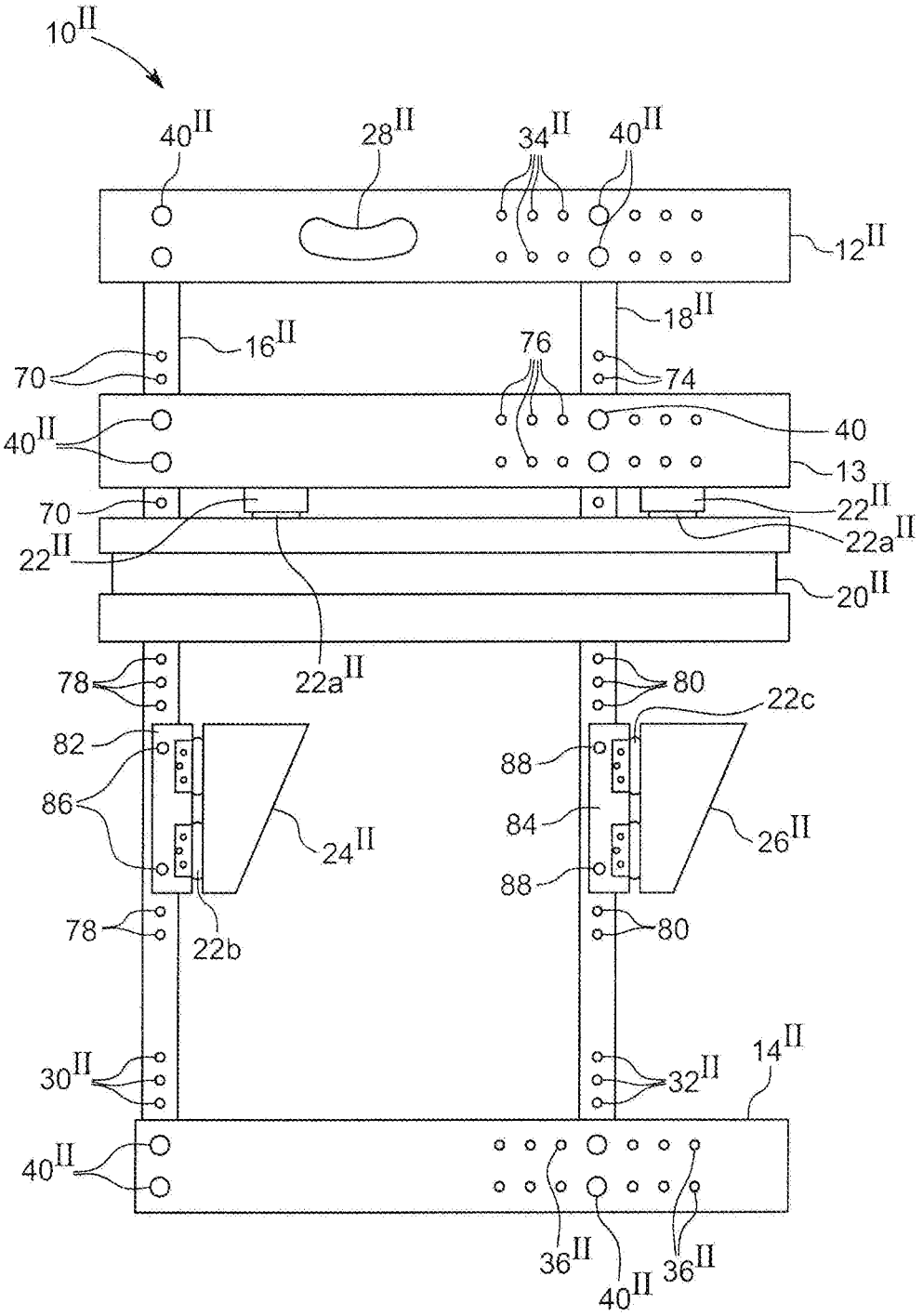
FIG. 21 is a front view in elevation of an adjustable deck shelf/deck seat assembly according to a still further embodiment of the disclosure.
Figure 22:
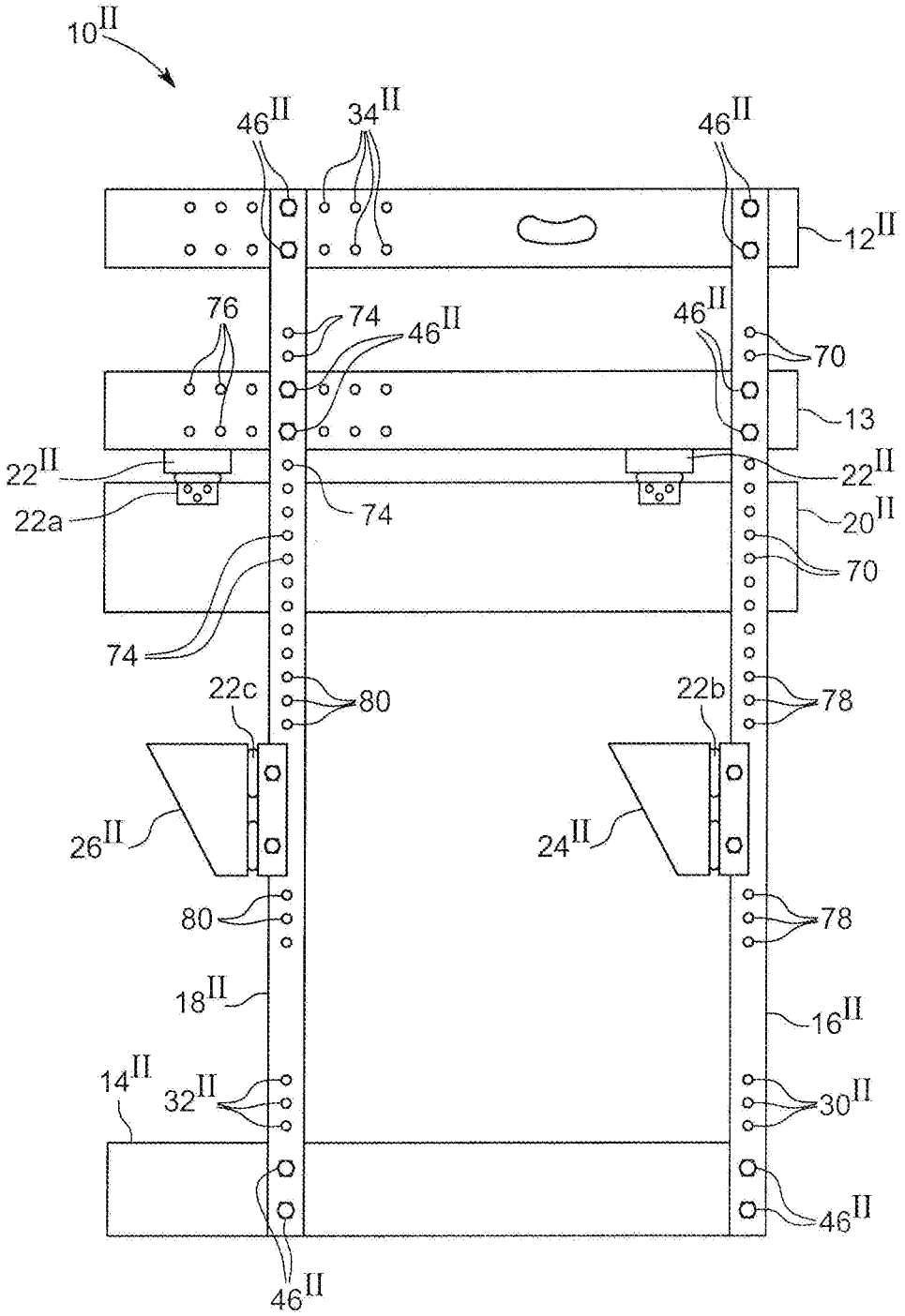
FIG. 22 is a back view in elevation of the adjustable deck shelf/deck seat assembly shown in FIG. 21 without upper locking blocks.

Referring still to FIGS. 21 and 22, to enable the components of deck shelf/seat assembly 10" to be rearranged to function as a shelf or a seat, a variable-height, secondary upper support board 13 is secured to support legs 16" and 18" below upper support board 12". To secure secondary upper support board 13 to first support leg 16", a plurality of secondary upper first-leg through-bores 70 are formed in first support leg 16" below first support leg upper through-bores 17". Secondary upper support board 13 is formed with a pair of vertically-oriented, secondary first-leg through-bores 72 (not shown) located proximal a first or left end of secondary upper support board 13 and dimensioned to receive mechanical fasteners and dimensioned and spaced to align with two of the plurality of secondary upper first-leg through-bores 70. A pair of mechanical fasteners 40", e.g., lag bolt and/or bolt/nut/washer combinations (described for deck shelf 10 and applicable to this embodiment) are each inserted into each pair of aligned through-bores 72 and 70 in secondary upper support board 13 and first support leg 16", respectively, and secured with nuts 46" to secure the top end of first support leg 16" to secondary upper support board 13. Once attached, the orientation of first support leg 16" to secondary upper support board 13 is substantially orthogonal. Other alignment orientations are possible and remain within the scope of the disclosure as disclosed in more detail herein.

Formed on a right side of secondary upper support board 13 is a plurality of secondary, second-leg through-bores 76. Through-bores 76 are substantially equally spaced and arranged in a pair of substantially parallel through-bore lines. The arrangement permits second support leg 18" to be secured to secondary upper support board 13 with mechanical fasteners 40". A plurality of secondary upper second-leg through-bores 74 are formed in second support leg 18" below second support leg upper through-bores 19". The spacing of the through-bores 74 is matched to the spacing of the substantially parallel rows of secondary, second-leg through-bores 76.

To set the horizontal distance between first support leg 16" and second support leg 18", a column of secondary, second-leg through-bores 76" is selected and aligned with a pair of secondary upper second-leg through-bores 74 and secured with mechanical fasteners 40". In similar fashion to deck shelf assembly 10', the spacing of the columns of secondary second-leg through-bores 76 set the defined horizontal distances possible between the two support legs. It should be understood that the number of columns of secondary, second-leg through-bores 76 can be varied and remain within the scope of the disclosure.

Secured to a bottom edge of secondary upper support board 13 are two or more hinge blocks 22" each used to support a hinge **22*a*". One plate of each hinge 22*a*" is secured to a front face of one hinge block 22". A second plate of each hinge 22*a*" is secured to a bottom or back surface of a shelf-support board 20". The hinge plates are held together with pins secured in the hinge plate knuckles as is commonly known in the art. Shelf support board 20" is elongate and may have substantially the same length as upper support board 12" and secondary upper support board 13. It should be understood that the length of shelf support board 20" can be varied relative to upper support board 12"** and remain within the scope of the disclosure.

Shelf support board 20" has the same features of shelf support board 20 shown in FIGS. 1, 2 and 7-10 including all variations disclosed herein. The description of the features of shelf support board 20 are incorporated here by reference with respect to shelf support board 20".

To secure shelf support board 20" in an up or use position, a pair of retractable, variable-height truss shelf supports, a first variable-height truss shelf support 24" and a second variable-height, truss shelf support 26", are provided. As shown in FIGS. 21 and 22, first variable-height, truss shelf support 24" is secured to first support leg 16" with a first outrigger sleeve 82. A first pair of hinges **22*b*, each positioned proximal an upper or lower end of first variable-height, truss shelf support 24" is secured to second support leg 18" with a second outrigger sleeve 84. A second pair of hinges 22*c*, each positioned proximal an upper or lower end of second variable-height, truss shelf support 26" secure shelf support 26" to second outrigger sleeve 84. As shown, both variable-height, truss shelf supports are substantially triangular in shape with a wider surface at the top relative to the bottom of the truss shelf supports. It should be understood that the length of the top surface of the truss shelf supports are dimensioned to register against a substantial portion if not the entire dimension of the top-to-bottom width of shelf support board 20". It should be further understood that the overall shape of the truss shelf supports can be varied and remain within the scope of the disclosure as long as the top dimension of the truss shelf support register against a substantial portion of the width of shelf support board 20"**, which can be, illustratively, at least 75% of the width.

Figure 23:
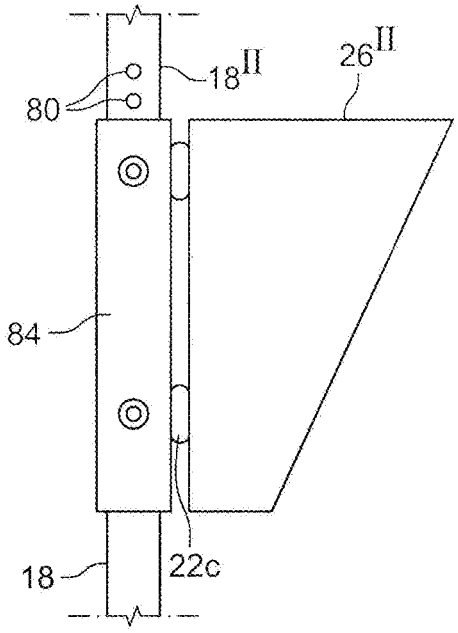
FIG. 23 is a front view in elevation of an adjustable shelf/seat support outrigger/truss subassembly according to the embodiment of the disclosure shown in FIG. 21.
Figure 24:
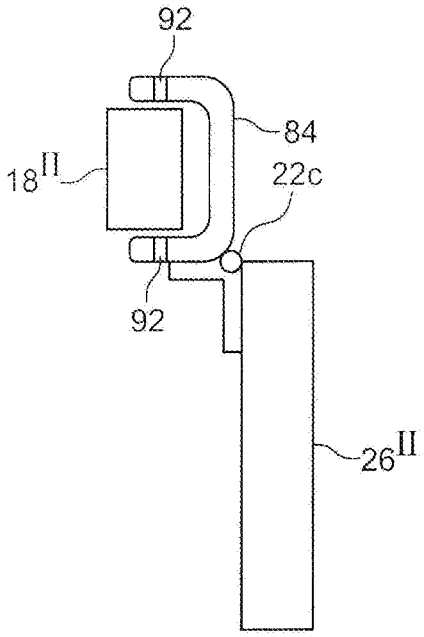
FIG. 24 is a top view of the adjustable shelf/seat support outrigger/truss subassembly shown in FIG. 23 with the rotatable shelf/seat support in a storage position.
Figure 25:
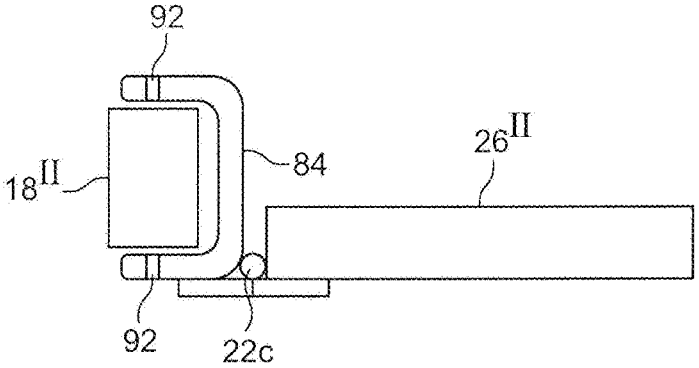
FIG. 25 is a top view of the adjustable shelf/seat support outrigger shown in FIG. 23 in a deployed/operational support position.

First outrigger sleeve 82 and second outrigger sleeve 84 are both formed as elongate, square "U-shaped" tubes in cross section as shown in FIGS. 23-25. Each outrigger sleeve is formed with at least two spaced through-bores to receive mechanical fasteners 40". The overall dimensions of the outrigger sleeves are set to freely slide over first and second support legs 16" and 18".

To secure first outrigger sleeve 82 to first support leg 16", a plurality of first support leg outrigger through-bores 78 are formed in first support leg 16" below secondary upper first-leg through-bores 70. A pair of vertically-oriented, first outrigger sleeve though-bores 90 (illustratively four) are formed in each of the parallel legs of the "U-shaped" sleeve (similar to second outrigger sleeve through-bores 92 shown in FIG. 26) and spaced to match the spacing of first support leg outrigger through-bores 78. To set the height of first outrigger sleeve 82 and the attached first variable-height truss shelf support 24", first outrigger sleeve through-bores 90 are aligned with a pair of first support leg outrigger through-bores 78. Once aligned, mechanical fasteners 40" are inserted into the aligned through-bores and secured with nuts 46". Whether a shelf 50 attached to shelf support board 20" is used as a seat or as a shelf is simply determined by the height selected from the shelf support board and the variable-height truss shelf supports. It should be further understood that secondary upper first-leg through-bores 70 and first support leg outrigger through-bores 78 can be a continuous column of through-bores to accommodate a wide range of shelf and seat heights.

To secure second outrigger sleeve 84 to second support leg 18", a plurality of second support leg outrigger through-bores 80 are formed in second support leg 18" below secondary upper second-leg through-bores 74. A pair of vertically-oriented, second outrigger sleeve though-bores 92 (illustratively four) are formed in each of the parallel legs of the "U-shaped" sleeve, as shown in FIG. 26, and spaced to match the spacing of second support leg outrigger through-bores 80. To set the height of second outrigger sleeve 84 and the attached second variable-height truss shelf support 26", second outrigger sleeve through-bores 92 are aligned with a pair of second support leg outrigger through-bores 80. Once aligned, mechanical fasteners 40" are inserted into the aligned through-bores and secured with nuts 46". Whether a shelf 50 attached to shelf support board 20" is used as a seat or as a shelf is simply determined by the height selected from the shelf support board and the variable-height truss shelf supports. It should be further understood that secondary upper second-leg through-bores 74 and second support leg outrigger through-bores 80 can be a continuous column of through-bores to accommodate a wide range of shelf and seat heights.

With respect to the through-bores formed in the support legs, it should be understood for any of the embodiments of either the deck shelf assembly or the desk shelf/seat assembly, multiple columns of through-bores may be used in the support legs to add additional structural strength to the connection between the support legs and the various components secured to the support legs. In addition, more than two rows of through-bores may be formed in any of the support boards to provide additional support for the assembled structures. To that end, all through-bores may be dimensioned equally and spaced equally with respect to spacing in rows and columns to create a standardized but variable assembly structure.

To position first and second variable-height truss shelf supports 24" and 26" in closed of storage positions, the truss shelf supports are rotated on their hinges so the faces of the truss shelf supports are positioned along a plane occupied by the two support legs. To position the variable-height truss shelf supports in an operational position, shelf support board 20" is rotated into its up or operational position. Once this step is completed, shelf support board 20" is held in the up position while each of the variable-height truss shelf supports is rotated so their faces are oriented orthogonal to the plane occupied by the two support legs. Once in their operational position, shelf support board 20" to be released and allowed to register against the top surfaces of variable-height truss shelf supports 24" and 26". To place the shelf support board and variable-height truss shelf supports in storage positions, the described process is reversed. Shelf support board 20" is held in an up position while the two variable-height truss shelf supports are rotated inwardly to align with the support legs. The shelf support board is then rotated to its storage position, which overlaps the truss shelf supports and maintains them in their storage positions. Detents, not shown, may be used to lock the truss shelf supports in their operational positions as is well known in the art.

Once deck shelf/seat assembly 10" is arranged in its operational position, shelf 50 or any of the disclosed variations of shelf 50 are secured to shelf support board 20" in the same manner described for deck shelf assembly 50. Included in the variations possible for shelf 50 is a seat-shaped insert that has larger radiused edges to function as a comfortable seat. Modifications also may be made to accommodate the incorporation of seat cushions on shelf 50.

The materials used to construct the various components of the deck shelf assembly are in sheet or board form and may be made from wood, composite wood, polyvinylchloride, cellular PVC or any similar material known in the art. The key feature needed in any material used is sufficient rigidity for use as a shelf or seat. The material should be resistant to fluids such as water and temperature fluctuations as well as UV light degradation to ensure the integrity of the assembly in all weather conditions.

While the present disclosure has been described in connection with several embodiments thereof, it will be apparent to those skilled in the art that many changes and modifications may be made without departing from the true spirit and scope of the present disclosure. Accordingly, it is intended by the appended claims to cover all such changes and modifications as come within the true spirit and scope of the disclosure.

What we claim as new and desire to secure by United States Letters Patent is:

1. An deck shelf assembly comprising:

an upper support board formed with a pair of vertically-aligned first upper support board through-bores proximal a first end and at least a pair of second upper support board through-bores proximal a second end, wherein at least two hook-engaging slots are formed apart and proximal to a bottom end of the upper support board;

a first support leg having a pair of vertically-aligned upper first-leg through-bores aligned with the pair of first upper support board through-bores and a second pair of vertically-aligned lower first-leg through-bores;

a second support leg having a pair of vertically-aligned upper second-leg through-bores aligned with the at least a pair of second upper support board through-bores and a second pair of vertically-aligned lower second-leg through-bores;

a lower support board having a pair of vertically-aligned lower support board through-bores formed proximal a first end and aligned with the second pair of vertically-aligned lower first leg through-bores and at least a pair of vertically-aligned second lower support board through-bores, wherein the at least a pair of vertically-aligned second lower support board through-bores are aligned with the second pair of vertically-aligned lower second leg through-bores;

a pair of locking blocks, a first upper support block secured to a back side of the first support leg and a second upper support block secured to a back side of the second support leg;

a shelf support board secured to a bottom edge of the upper support board; and, a shelf having at least two hooks extending from a back end of the shelf, wherein each of the at least two hooks is aligned with one of the at least two hook-engaging slots; and wherein the shelf is secured on top of the shelf support board.

2. The deck shelf assembly of claim 1 further comprising a pair of truss supports comprising a first truss support secured to the first support leg via one or more hinges and a second truss support secured to the second support leg via one or more hinges.

3. The deck shelf assembly of claim 1 further comprising at least two hinge blocks secured to a bottom of the upper support board, wherein each hinge block is located proximal one end of the upper support board, and wherein each hinge block is secured to the shelf support board via one or more hinges.

4. The deck shelf assembly of claim 1 comprising a first-leg lower locking block secured to a bottom back end of the first support leg, wherein the first-leg lower locking block can extend laterally or downwardly from the first support leg.

5. The deck shelf assembly of claim 1 comprising a second-leg lower locking block secured to a bottom back end of the second support leg, wherein the second-leg lower locking block can extend laterally or downwardly from the second support leg.

6. The deck shelf assembly of claim 1 wherein the upper support board has a plurality of second upper support board through-bores proximal a second end, wherein the plurality of second upper support board through-bores are arranged in a pair of substantially parallel rows.

7. The deck shelf assembly of claim 1 wherein the lower support board has a plurality of second lower support board through-bores proximal a second end, wherein the plurality of second lower support board through-bores are arranged in a pair of substantially parallel rows.

8. The deck shelf assembly of claim 1 wherein the first support leg is secured to the upper support board and the lower support board via mechanical fasteners and the second support leg is secured to the upper support board and the lower support board via mechanical fasteners.

9. An deck assembly comprising:

an upper support board formed with a pair of vertically-aligned first upper support board through-bores proximal a first end and at least a pair of second upper support board through-bores proximal a second end and;

a first support leg having a pair of vertically-aligned upper first-leg through-bores aligned with the pair of first upper support board through-bores, a plurality of secondary upper first-leg through-bores formed below the upper first-leg through bores, and a second pair of vertically-aligned lower first-leg through-bores;

a second support leg having at least a pair of vertically-aligned upper second-leg through-bores aligned with the at least a pair of second upper support board through-bores, a plurality of secondary second-leg through-bores formed below the upper second-leg through-bores, and at least a second pair of vertically-aligned lower second-leg through-bores;

a variable-height, secondary upper support board secured to the first support leg and the second support leg, wherein the secondary upper support board is formed with at least a pair of vertically-oriented, secondary first-leg through-bores located proximal a first or left end of the secondary upper support board and aligned with two of the plurality of secondary upper first-leg through-bores, wherein the secondary upper support board is further formed with at least a pair of secondary, second-leg through bores proximal a second or right end of the secondary upper support board and aligned with two of the plurality of secondary second-leg through-bores, wherein at least two hook-engaging slots are formed apart and proximal to a bottom end of the secondary upper support board;

a lower support board having a pair of vertically-aligned lower support board through-bores formed proximal a first end and aligned with the second pair of vertically-aligned lower first leg through-bores and at least a pair of vertically-aligned second lower support board through-bores, wherein the at least a pair of vertically-aligned second lower support board through-bores are aligned with the second pair of vertically-aligned lower second leg through-bores;

a pair of locking blocks, a first upper support block secured to a back side of the first support leg and a second upper support block secured to a back side of the second support leg;

a shelf support board secured to a bottom edge of the secondary upper support board via one or more hinges; and a shelf having at least two hooks extending from a back end of the shelf, wherein each of the at least two hooks is aligned with one of the at least two hook-engaging slots in the secondary upper support board, and wherein the shelf is registered against, and on top of, the shelf support board.

10. The deck assembly of claim 9 further comprising a pair of height-variable outrigger sleeves and hinged truss shelf-support subassemblies, wherein a first height-variable outrigger sleeve is secured to a first truss shelf support via one or more hinges and is secured to the first support leg, wherein a second height variable outrigger sleeve is secured to a second truss shelf support via one or more hinges and is secured to the second support leg.

11. The deck assembly of claim 10 wherein the first outrigger sleeve and the second outrigger sleeve are both formed as elongate, square "U-shaped" tubes in cross section, wherein each outrigger sleeve is formed with at least two spaced through-bores to receive mechanical fasteners, and wherein the overall dimensions of the outrigger sleeves are set to freely slide over the first and the second support legs.

12. The deck assembly of claim 11, wherein a plurality of first support leg outrigger through-bores are formed in the first support leg below the secondary upper first-leg through-bores, and wherein at least a pair of vertically-oriented, first outrigger sleeve though-bores are formed in each of the parallel legs of the "U-shaped" first outrigger and spaced to match the spacing of the first support leg outrigger through-bores.

13. The deck assembly of claim 12, further comprising mechanical fasteners securing the first outrigger sleeve to the first support leg.

14. The deck assembly of claim 11, wherein a plurality of second support leg outrigger through-bores are formed in the second support leg below the secondary upper second-leg through-bores, and wherein at least a pair of vertically-oriented, second outrigger sleeve though-bores are formed in each of the parallel legs of the "U-shaped" second outrigger and spaced to match the spacing of the second support leg outrigger through-bores.

* * * * *